US009756875B2

(12) United States Patent
Atchley et al.

(10) Patent No.: US 9,756,875 B2
(45) Date of Patent: Sep. 12, 2017

(54) COMPOSITE SMOKELESS TOBACCO PRODUCTS, SYSTEMS, AND METHODS

(71) Applicant: Altria Client Services LLC, Richmond, VA (US)

(72) Inventors: Frank Scott Atchley, Tarpon Springs, FL (US); James M. Rossman, Tampa, FL (US); Munmaya K. Mishra, Manakin Sabot, VA (US)

(73) Assignee: ALTRIA CLIENT SERVICES LLC, Richmond, VA (US)

( * ) Notice: Subject to any disclaimer, the term of this patent is extended or adjusted under 35 U.S.C. 154(b) by 101 days.

(21) Appl. No.: 14/635,613

(22) Filed: Mar. 2, 2015

(65) Prior Publication Data

US 2015/0264974 A1 Sep. 24, 2015

Related U.S. Application Data

(63) Continuation of application No. 13/198,023, filed on Aug. 4, 2011, now Pat. No. 8,978,661.

(60) Provisional application No. 61/452,394, filed on Mar. 14, 2011, provisional application No. 61/371,036, filed on Aug. 5, 2010.

(51) Int. Cl.

| | |
|---|---|
| ***A24B 13/00*** | (2006.01) |
| ***A24F 23/00*** | (2006.01) |
| ***A24B 15/28*** | (2006.01) |

(52) U.S. Cl.

CPC ..... *A24B 13/00* (2013.01); *A24B 15/28* (2013.01); *A24F 23/00* (2013.01)

(58) Field of Classification Search

USPC ..... 131/111, 52, 347, 3; 206/242, 256, 260, 206/269

See application file for complete search history.

(56) References Cited

U.S. PATENT DOCUMENTS

| | | | | |
|---|---|---|---|---|
| 2,580,609 A | | 1/1952 | Schur et al. | |
| 2,734,509 A | * | 2/1956 | Jurgensen, Jr. ..... | A24B 15/12 131/354 |
| 3,354,863 A | | 11/1967 | Reynolds et al. | |
| 4,084,627 A | | 4/1978 | Focke et al. | |

(Continued)

FOREIGN PATENT DOCUMENTS

| | | |
|---|---|---|
| CN | 101272703 | 9/2008 |
| CN | 101495002 | 7/2009 |

(Continued)

OTHER PUBLICATIONS

"Air knife—Wikipedia, the free encyclopedia", Jan. 27, 2014 (Jan. 27, 2014), XP055196211, Retrieved from the Internet: URL: http://web.archive.org/web/20140127191900/http://en.wikipedia.org/wiki/Air_knife [retrieved on Jun. 16, 2015] the whole document.

(Continued)

*Primary Examiner* — Dennis Cordray

(74) *Attorney, Agent, or Firm* — Fish & Richardson P.C.

(57) ABSTRACT

A smokeless tobacco product includes smokeless tobacco and a polymeric material in intimate contact with the smokeless tobacco and stabilized in conformance to a surface topography of the tobacco's fibrous structures such that the stabilized polymeric material secures the smokeless tobacco together. The smokeless tobacco product has a moisture-permeable porous surface and an overall oven volatiles content of at least 10 weight percent.

20 Claims, 17 Drawing Sheets

(56) References Cited

U.S. PATENT DOCUMENTS

| | | | | |
|---|---|---|---|---|
| 4,090,521 | A | 5/1978 | Elsner | |
| 4,380,570 | A | 4/1983 | Schwarz | |
| 4,405,688 | A | 9/1983 | Lowery et al. | |
| 4,516,590 | A | 5/1985 | Teng | |
| 4,526,733 | A | 7/1985 | Lau | |
| 4,528,993 | A | 7/1985 | Sensabaugh, Jr. et al. | |
| 4,660,577 | A | 4/1987 | Sensabaugh et al. | |
| 4,848,373 | A | 7/1989 | Lenkey | |
| 4,940,464 | A | 7/1990 | Van Gompel et al. | |
| 4,987,907 | A | 1/1991 | Townend | |
| 5,063,104 | A | 11/1991 | Robertson et al. | |
| 5,146,955 | A | 9/1992 | Steiner et al. | |
| 5,372,149 | A | 12/1994 | Roth et al. | |
| 5,476,616 | A | 12/1995 | Schwarz | |
| 5,528,993 | A | 6/1996 | Vincelli | |
| 5,645,790 | A | 7/1997 | Schwarz et al. | |
| 6,013,223 | A | 1/2000 | Schwarz | |
| 6,207,601 | B1 | 3/2001 | Maurer et al. | |
| 6,455,030 | B2 | 9/2002 | Saito et al. | |
| 6,716,498 | B2 | 4/2004 | Curro et al. | |
| 7,156,937 | B2 | 1/2007 | Provost et al. | |
| 7,465,366 | B2 | 12/2008 | Provost et al. | |
| 7,547,469 | B2 | 6/2009 | Provost et al. | |
| 7,562,426 | B2 | 7/2009 | Barker et al. | |
| 7,666,261 | B2 | 2/2010 | Bailey et al. | |
| 7,718,556 | B2 | 5/2010 | Matsuda et al. | |
| 7,810,507 | B2 | 10/2010 | Dube et al. | |
| 9,386,800 | B2 * | 7/2016 | Sebastian | A24B 13/00 |
| 2001/0022988 | A1 | 9/2001 | Schwarz et al. | |
| 2004/0038022 | A1 | 2/2004 | Maugans et al. | |
| 2004/0038790 | A1 | 2/2004 | Pehmoller et al. | |
| 2004/0118421 | A1 | 6/2004 | Hodin et al. | |
| 2004/0118422 | A1 | 6/2004 | Lundin et al. | |
| 2004/0209540 | A1 | 10/2004 | Schwarz | |
| 2005/0056956 | A1 | 3/2005 | Zhao et al. | |
| 2005/0178398 | A1 | 8/2005 | Breslin et al. | |
| 2005/0196580 | A1 | 9/2005 | Provost et al. | |
| 2005/0196583 | A1 | 9/2005 | Provost et al. | |
| 2005/0217092 | A1 | 10/2005 | Barker et al. | |
| 2005/0244521 | A1 | 11/2005 | Strickland et al. | |
| 2006/0191548 | A1 | 8/2006 | Strickland et al. | |
| 2006/0264130 | A1 | 11/2006 | Karles et al. | |
| 2006/0292271 | A1 | 12/2006 | King | |
| 2007/0261707 | A1 | 11/2007 | Winterson et al. | |
| 2008/0209586 | A1 | 8/2008 | Nielsen et al. | |
| 2008/0302682 | A1 | 12/2008 | Engstrom et al. | |
| 2008/0305297 | A1 | 12/2008 | Barker et al. | |
| 2008/0308115 | A1 | 12/2008 | Zimmermann | |
| 2009/0133703 | A1 * | 5/2009 | Strickland | A24B 13/00 131/111 |
| 2009/0189319 | A1 | 7/2009 | Kim | |
| 2009/0203280 | A9 | 8/2009 | Provost et al. | |
| 2009/0256277 | A1 | 10/2009 | Brown et al. | |
| 2009/0258099 | A1 | 10/2009 | Brown et al. | |
| 2009/0258562 | A1 | 10/2009 | Brown et al. | |
| 2010/0018539 | A1 | 1/2010 | Brinkley et al. | |
| 2010/0018882 | A1 | 1/2010 | St. Charles | |
| 2010/0018883 | A1 | 1/2010 | Patel | |
| 2010/0170522 | A1 | 7/2010 | Sun et al. | |
| 2010/0242978 | A1 | 9/2010 | Fuisz | |
| 2010/0300465 | A1 | 12/2010 | Zimmermann | |
| 2011/0036364 | A1 | 2/2011 | Pienemann et al. | |
| 2011/0083688 | A1 | 4/2011 | Mishra et al. | |
| 2011/0220130 | A1 | 9/2011 | Mua et al. | |
| 2012/0024301 | A1 | 2/2012 | Carroll et al. | |
| 2012/0031414 | A1 | 2/2012 | Atchley et al. | |
| 2012/0031416 | A1 | 2/2012 | Atchley et al. | |
| 2012/0103353 | A1 | 5/2012 | Sebastian et al. | |

FOREIGN PATENT DOCUMENTS

| | | |
|---|---|---|
| CN | 101548797 | 10/2009 |
| CN | 101873809 | 10/2010 |
| CN | 103551046 | 2/2014 |
| DE | 10346649 | 5/2005 |
| EP | 0311364 | 4/1989 |
| EP | 1990448 | 11/2008 |
| EP | 2642556 | 9/2013 |
| GB | 2373988 | 12/2006 |
| JP | H04-91773 | 3/1992 |
| JP | 2002-176964 | 6/2002 |
| JP | 3872341 | 1/2007 |
| JP | 2007-515950 | 6/2007 |
| JP | 2009-203412 | 9/2009 |
| JP | 2012/199034 | 10/2012 |
| KR | 100857523 | 9/2008 |
| WO | WO95/20432 | 8/1995 |
| WO | WO01/51701 | 7/2001 |
| WO | WO2005/046363 | 5/2005 |
| WO | WO2005/090653 | 9/2005 |
| WO | WO2005/115180 | 12/2005 |
| WO | WO2007/037962 | 4/2007 |
| WO | WO2008/015573 | 2/2008 |
| WO | WO2009/010878 | 1/2009 |
| WO | WO2009/048522 | 4/2009 |
| WO | WO2009/063010 | 5/2009 |
| WO | WO2009/065459 | 5/2009 |
| WO | WO2010/078437 | 7/2010 |
| WO | WO2010/087921 | 8/2010 |
| WO | WO2011/117751 | 9/2011 |
| WO | WO2011/130414 | 10/2011 |

OTHER PUBLICATIONS

International Preliminary Report on Patentability for PCT/US2011/046636 dated Feb. 14, 2013, 7 pages.

International Preliminary Report on Patentability for PCT/US2011/046625, dated Feb. 14, 2013, 6 pages.

International Search Report and Written Opinion in International Application No. PCT/US2014/028242, dated Jul. 15, 2014, 12 pages.

International Search Report and Written Opinion in International Application No. PCT/US2014/028325, dated Sep. 8, 2014, 12 pages.

International Search Report and Written Opinion in International Application No. PCT/US2014/028389, dated Aug. 4, 2014, 9 pages.

International Search Report and Written Opinion in Internationl Application No. PCT/US2014/028354, dated Jul. 10, 2014, 12 pages.

International Search Report and Written Opinion in PCT/US2011/046636, dated Apr. 12, 2012, 14 pages.

International Search Report and Written Opinion in PCT/US2015/020449, dated Sep. 7, 2015, 13 pages.

International Search Report and Written Opnion in PCT/US2011/046625, dated Apr. 12, 2012, 12 pages.

International Search Report for Application No. PCT/US2015/020454, dated Jun. 30, 2015, 15 pages.

Invitation to Pay Fees in International Application No. PCT/US2014/028584, dated Sep. 9, 2014, 6 pages.

Rydholm, Pulping Processes, Interscience Publishers, 1967, 51-52.

Tso, Chapter 1 in Tobacco, Production, Chemistry and Technology, 1999, Davis & Nielsen, eds., Blackwell Publishing, Oxford.

Yarin et al., "Upward needleless electrospinning of multiple nanofibers," Polymer, Elsevier Science Publishers B.V, GB, vol. 45, No. 9, Apr. 1, 2004 (Apr. 1, 2004), p. 2977-2980, XP004499264, ISSN: 0032-3861, DOI: 10.1016/J.Polymer.2004.02.066 the whole document.

* cited by examiner

COMPOSITE SMOKELESS TOBACCO PRODUCTS, SYSTEMS, AND METHODS

CROSS-REFERENCE TO RELATED APPLICATIONS

This application is a continuation of U.S. Ser. No. 13/198,023, filed on Aug. 4, 2011, which claims benefit of priority from U.S. Provisional Application Ser. No. 61/452,394, filed on Mar. 14, 2011 and U.S. Provisional Application Ser. No. 61/371,036, filed on Aug. 5, 2010.

TECHNICAL FIELD

This disclosure generally relates to composite smokeless tobacco products including polymeric material in intimate contact with smokeless tobacco and stabilized in conformance to a surface topography of tobacco's fibrous structures. Methods of making and using the composite smokeless tobacco products are also described.

BACKGROUND

Smokeless tobacco is tobacco that is placed in the mouth and not combusted. There are various types of smokeless tobacco including: chewing tobacco, moist smokeless tobacco, snus, and dry snuff. Chewing tobacco is coarsely divided tobacco leaf that is typically packaged in a large pouch-like package and used in a plug or twist. Moist smokeless tobacco is a moist, more finely divided tobacco that is provided in loose form or in pouch form and is typically packaged in round cans and used as a pinch or in a pouch placed between an adult tobacco consumer's cheek and gum. Snus is a heat treated smokeless tobacco. Dry snuff is finely ground tobacco that is placed in the mouth or used nasally.

SUMMARY

A smokeless tobacco product is described that includes smokeless tobacco and a polymeric material in intimate contact with the smokeless tobacco and stabilized in conformance to a surface topography of the tobacco's fibrous structures such that the stabilized polymeric material secures the smokeless tobacco together.

The smokeless tobacco can be a dry or moist smokeless tobacco. In some embodiments, the smokeless tobacco is moist smokeless tobacco having has an oven volatile content of about 30% by weight to about 61% by weight. In other embodiments, the smokeless tobacco is a dry snuff having an oven volatile content of between 2% and 15%. In some embodiments, the composite smokeless tobacco product has an overall oven volatile content of about 4% by weight to about 61% by weight. Some embodiments of a smokeless tobacco product include smokeless tobacco combined with melt-blown polymeric fibers so that the smokeless tobacco is secured by the melt-blown polymeric fibers. In particular embodiments, polymeric fibers are melt-blown along with or against smokeless tobacco. In other embodiments, spun bond polymeric fibers can be combined with the smokeless tobacco. Further, some systems include a container that retains a plurality of the melt-blown smokeless tobacco products, which can each have a substantially similar shape and/or volume.

In certain embodiments, a smokeless tobacco product includes smokeless tobacco distributed throughout a nonwoven network of structural fibers, with at least a portion of the nonwoven network of structural fibers including the melt-blown polymeric fibers or spun bond polymeric fibers. In some embodiments, the smokeless tobacco is homogeneously distributed throughout the nonwoven network of structural fibers.

Methods of preparing the smokeless tobacco product are also described. The method includes bringing a polymeric material and smokeless tobacco into intimate contact to conform the polymeric material to the tobacco's fibrous structures. In some embodiments, the polymeric material is formed into strands having a diameter of less than 100 microns and deposited against smokeless tobacco such that the strands conform to the tobacco's fibrous structures. In some embodiments, the strands are cooled to below their glass transition temperature prior to contact with the smokeless tobacco, but the flow of the strands results in conformance with the tobacco's fibrous structures. The method forms a composite tobacco product including the polymeric material and the smokeless tobacco. The composite tobacco product has a moisture-permeable porous surface.

In other embodiments, discrete deposits of smokeless tobacco can be encapsulated by one or more nonwoven polymeric fabrics. For example, discrete deposits of smokeless tobacco may be passed through a stream of melt-blown polymeric fibers. Discrete deposits of smokeless tobacco can also be deposited onto a polymeric web prior to passing the discrete deposits through a stream of melt-blown polymeric fibers to provide a top coating. In some embodiments, the polymeric web is heated. The composite can then be optionally further bonded and cut to produce smokeless tobacco products including a discrete deposit of smokeless tobacco enveloped by two layers of nonwoven fabric. The nonwoven fabrics can provide an adult tobacco consumer with a desirable mouth feel and flavor profile.

Methods are also disclosed that include bringing a polymeric material and tobacco into intimate contact while the polymeric material is at a temperature above its glass-transition temperature. After the polymeric material conforms to the tobacco's fibrous structures, the polymeric material is stabilized in contact with the smokeless tobacco by bringing the polymeric material below its glass transition temperature. In some embodiments, the polymeric material is directed towards the smokeless tobacco in strands (e.g., from a melt-blowing apparatus). The method forms a composite tobacco product including the polymeric material and the smokeless tobacco.

In some embodiments, melt-blown or spun bond polymeric fibers are deposited with or against smokeless tobacco to form a homogeneous or semi-homogeneous distribution of smokeless tobacco within a nonwoven network of melt-blown polymeric fibers. In certain embodiments, smokeless tobacco is introduced to a flow of polymeric fibers exiting an array of spinnerets. In other embodiments, multiple layers of melt-blown polymeric fibers and/or spun bond polymeric fibers and smokeless tobacco are sequentially deposited and then bonded. For example, by depositing layers of smokeless tobacco of about 0.1 inches, the subsequent deposition of polymeric fibers can disrupt the smokeless tobacco and cause the smokeless tobacco to become entangled with the polymeric fibers. Moreover, other disrupting techniques can be used to cause the smokeless tobacco to become dispersed within a matrix of melt-blown polymeric fibers.

In certain embodiments, additional processing of a layered structure of smokeless tobacco and polymeric fibers can further secure the smokeless tobacco to the polymeric fibers. For example, a layered structure of melt-blown polymeric fibers and smokeless tobacco can be needled to secure the smokeless tobacco to the melt-blown polymeric fibers. In other embodiments, spun lacing, hydroentangling, spun jetting, air jetting, needling, needle punching, needle felting, thermal bonding, ultrasonic bonding, radiation bonding, chemical bonding, stitch bonding, and quilting techniques can be used to further secure the smokeless tobacco to polymeric fibers.

In some embodiments, a smokeless tobacco product for oral use includes smokeless tobacco and a plurality of polymeric fibers. The smokeless tobacco can be at least partially secured to the plurality of polymeric fibers to retain cohesion of each smokeless tobacco product when placed within an adult tobacco consumer's mouth and exposed to saliva. In some embodiments, a system includes a container including a lid and a base that defines an interior space. A plurality of smokeless tobacco products can be disposed in the interior space of the container. The plurality of smokeless tobacco products can each have a substantially similar shape and/or volume.

A melt-blown smokeless tobacco product can have a thickness of between 0.1 and 1.0 inches. In some embodiments, smokeless tobacco is exposed along at least one exterior surface of the melt-blown smokeless tobacco product.

The smokeless tobacco can have an oven volatiles content of between 4% and 61%. In certain embodiments, the smokeless tobacco can be moist smokeless tobacco having an oven volatiles content of between 30 and 61% weight percent in some embodiments. In other embodiments, the smokeless tobacco is a dry snuff having an oven volatile content of between 2% and 15%. In some embodiments, the smokeless tobacco is a snus having an oven volatile content of between 15% and 57%. In other embodiments, the smokeless tobacco can include an orally-disintegrable smokeless-tobacco composition, such as those described in US 2005/0244521 or US 2006/0191548 (which are hereby incorporated by reference). In some embodiments, the smokeless tobacco includes flavorants and/or other additives.

The polymeric fibers can be polymers safe for oral use. Suitable polymers include polypropylene, low density polyethylene, polyethylene terephthalate, polyurethane, polyvinyl acetate, polyvinyl alcohol, cellulosic materials such as hydroxypropyl cellulose and combinations thereof. In some embodiments, reconstituted cellulosic fibers (e.g., derived from tobacco plant tissue) is used.

In certain embodiments, the smokeless tobacco is substantially homogeneously dispersed within the polymeric fibers of the smokeless tobacco product. In other embodiments, a body of smokeless tobacco can be encapsulated by one or more layers of nonwoven fabrics of polymeric fibers. For example, nonwoven fabric may encapsulate a body of smokeless tobacco. In some embodiments, the body of smokeless tobacco weighs between 0.25 and 4.0 grams.

Additional processing of the smokeless tobacco product can alter the surface features of the composite smokeless tobacco product. For example, the smokeless tobacco product can be embossed or stamped. Coatings, both partial and complete, can also be applied to the smokeless tobacco product. For example, one or more flavor strips may be applied to one or more exterior or interior surfaces of the composite smokeless tobacco product.

A package of the smokeless tobacco product can include a container that defines a moisture-tight interior space and at least one smokeless tobacco product described herein disposed in the moisture-tight interior space.

A method of using the smokeless tobacco product is also described. The method includes opening a container containing at least one smokeless tobacco product, removing at least a piece of the smokeless tobacco product, and placing the removed piece in an adult tobacco consumer's mouth.

The products and methods described herein can also be applied to other orally consumable plant materials in addition to smokeless tobacco. For example, some non-tobacco or "herbal" compositions have also been developed as an alternative to smokeless tobacco compositions. Non-tobacco products may include a number of different primary ingredients, including but not limited to, tea leaves, red clover, coconut flakes, mint leaves, ginseng, apple, corn silk, grape leaf, and basil leaf. In some embodiments, a non-tobacco product includes a non-tobacco plant material having fibrous structures and a polymeric material in intimate contact with the non-tobacco plant material and stabilized in conformance to a surface topography of the plant material's fibrous structures such that the stabilized polymeric material holds the plant's fibrous structures together. In some embodiments, such a non-tobacco smokeless product can further include tobacco extracts, which can result in a non-tobacco smokeless product providing a desirable mouth feel and flavor profile. In some embodiments, the tobacco extracts can be extracted from a cured and/or fermented tobacco by mixing the cured and/or fermented tobacco with water and removing the non-soluble tobacco material. In some embodiments, the tobacco extracts can include nicotine. The non-tobacco product can have a moisture-permeable porous surface and can have an overall oven volatiles content of at least 10 weight percent. In some embodiments, anon-tobacco product has an overall oven volatiles content of at least 40 weight percent.

Unless otherwise defined, all technical and scientific terms used herein have the same meaning as commonly understood by one of ordinary skill in the art to which the methods and compositions of matter belong. Although methods and materials similar or equivalent to those described herein can be used in the practice or testing of the methods and compositions of matter, suitable methods and materials are described below. In addition, the materials, methods, and examples are illustrative only and not intended to be limiting. All publications, patent applications, patents, and other references mentioned herein are incorporated by reference in their entirety.

DESCRIPTION OF DRAWINGS

FIG. 12A shows a smokeless tobacco product onto which flavor strips have been applied. FIG. 12B shows a smokeless tobacco product that has been wrapped or coated. The smokeless tobacco products of FIGS. 12B and 12C have been embossed with a leaf image.

Like reference symbols in the various drawings indicate like elements.

DETAILED DESCRIPTION

Figure 1:
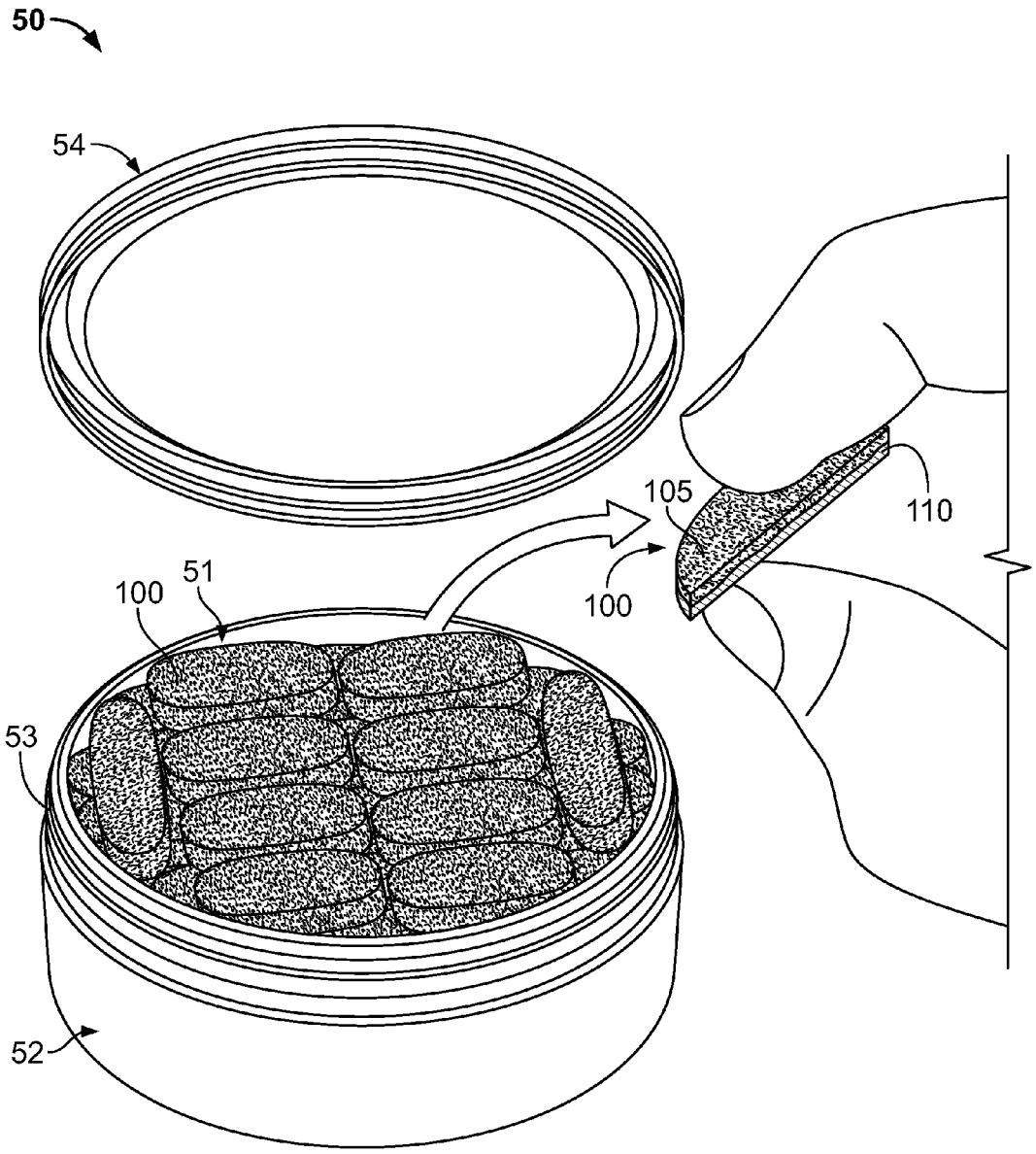
FIG. 1 is a perspective view of a system including one or more smokeless tobacco products.

This disclosure provides methods and materials for products having smokeless tobacco secured by polymeric materials. The polymeric material is in intimate contact with the smokeless tobacco and stabilized in conformance with fibrous structures of the smokeless tobacco. In some embodiments, polymeric strands having a diameter of less than 100 microns (e.g., melt-blown polymeric strands) are deposited onto smokeless tobacco to bring the polymeric strands into intimate contact with the tobacco's fibrous structures. In other embodiments, the method can include bringing a polymeric material and smokeless tobacco into intimate contact while the polymeric material is at a temperature above its glass transition temperature to conform the polymeric material to the smokeless tobacco. The resulting smokeless tobacco product can have a moisture-permeable porous surface. The disclosure is based, in part, on the surprising discovery that the resulting composite smokeless tobacco products provide a unique tactile and flavor experience to an adult tobacco consumer. In particular, the polymeric strands can provide a smooth mouth texture, bind the smokeless tobacco during use, but give the adult tobacco consumer good access to the smokeless tobacco. As compared to a typical pouch paper, the polymeric strands can be softer, be free of seams, have a lower basis weight, and act as less of a selective membrane.

The methods of forming the composite smokeless tobacco products are also described herein. The methods described herein result in products that remain cohesive and are less likely to break apart during packaging, handling, shipping, and during use by adult tobacco consumers. In some embodiments, smokeless tobacco is exposed along the product's outer surface and thus permits direct contact of smokeless tobacco with the adult tobacco consumer's cheek or gums. In other embodiments, the polymeric material forms a soft and highly porous coating around the smokeless tobacco. The methods described herein can enrobe or entangle smokeless tobaccos that are not suitable for being pouched using a typical pouching operation, for example smokeless tobaccos having an average partial aspect ratio of greater than 3 (e.g., long-cut smokeless tobacco).

The described combinations of the polymeric material and smokeless tobacco can provide a softer mouth feel. Moreover, in certain embodiments, the polymeric material can be elastic or pliable (e.g., a polymeric polyurethane such as DESMOPAN DP 9370A available from Bayer) thus forming a smokeless tobacco product that can better tolerate being "worked" in the mouth. For example, the smokeless tobacco product can be worked to provide flavor and/or to comfortably conform between the cheek and gum. In some embodiments, combinations of mouth-stable and mouth-dissolvable polymeric materials are combined with the smokeless tobacco to provide a product that becomes looser when placed in an adult tobacco consumer's mouth, yet remains generally cohesive. Polymeric structural fibers can also be a composite of multiple materials, which may include both mouth-stable and mouth-dissolvable materials.

The composite smokeless tobacco products can include polymeric structural fibers. The structural fibers can form a woven or nonwoven network. As used herein, the term "structural fibers" refers to fibers that enable the composite smokeless tobacco product to be cohesive when handled or placed within an adult tobacco consumer's mouth. As used herein, the term "nonwoven" means a material made from fibers that are connected by entanglement and/or bonded together by a chemical, heat or solvent treatment where the material does not exhibit the regular patterns of a woven or knitted fabric. Smokeless tobacco, for example, can be introduced into a stream of melt-blown polymeric material either loosely or as a body. In some embodiments, the stream of melt-blown polymeric material will coat the smokeless tobacco to form a soft and porous coating around the smokeless tobacco. The melt-blown polymeric material can encapsulate the smokeless tobacco, or coat one side of the smokeless tobacco and be joined to an adjacent layer of fibers. In other embodiments, the smokeless tobacco can be added to the stream of melt-blown polymeric material such that the smokeless tobacco becomes entangled in the polymeric structural fibers.

In other embodiments, polymeric structural fibers can be produced and contacted with smokeless tobacco while the polymeric fibers are still above their glass transition temperature. Polymeric materials can also be heated and then pressed against smokeless tobacco and/or be heated while being pressed against smokeless tobacco. In some embodiments, the polymeric material is a porous sheet or web. For example, a polymeric sheet or web can be heated and pressed against smokeless tobacco to conform the polymeric material to a surface topography of fibrous structures of the smokeless tobacco. Multiple layers of polymeric material and/or smokeless tobacco may be applied to produce layered composite smokeless tobacco products. Individual tobacco portions can also be made by layering polymeric material on opposite sides of a discrete deposit or body of smokeless tobacco followed by cutting the portions from the web.

Additional processes can also be used to further secure the smokeless tobacco to the polymeric structural fibers. Although other methods of producing the composite smokeless tobacco product are also contemplated, various methods of producing various composite smokeless tobacco products are discussed in more detail below.

The composite smokeless tobacco product can also be dimensionally stable. As used herein, "dimensionally stable" means that the composite smokeless tobacco product retains its shape under its own weight. In some embodiments, a composite smokeless tobacco product is flexible, yet can be picked up at one end without the force of gravity causing the composite smokeless tobacco product to bend or sag. In other embodiments, the composite smokeless tobacco product can be easily deformable. For example, loosely packed long-cut smokeless tobacco can be coated on opposite sides by melt-blown polymeric fibers, with edges of the melt-blown polymeric fibers bound such that the composite smokeless-tobacco product sags when picked up.

Exemplary Packaging System and Method of Use

Referring to FIG. 1, some embodiments of a smokeless tobacco system 50 can include one or more smokeless tobacco products 100 containing smokeless tobacco 105 stabilized by a polymeric material 110. The polymeric material can be stabilized in conformance to a surface topography of tobacco's fibrous structures such that the polymeric material holds the tobacco's fibrous structures together. In some embodiments, the polymeric material is in the form of structural fibers having diameters of less than 100 microns (or less than 50 microns, or less than 30 microns, or less than 10 microns, or less than 5 microns, or less than 1 micron, or less than 0.5 microns, or less than 0.1 microns, or less than 0.05 microns, or less than 0.01 microns), such that the structural fibers conform to the tobacco's fibrous structures. In some embodiments, the structural fibers have a diameter of between 0.5 and 5 microns. A plurality of smokeless tobacco products 100 can be arranged in an interior space 51 of a container 52 that mates with a lid 54. The plurality of the composite smokeless tobacco products 100 arranged in the container 52 can all have a substantially similar shape so that an adult tobacco consumer can conveniently select any of the similarly shaped smokeless tobacco products 100 therein and receive a generally consistent portion of the smokeless tobacco 105. In other embodiments, the container 52 can include a strip of composite smokeless tobacco product and an adult tobacco consumer can separate pieces of the strip and place those pieces in his or her mouth.

Still referring to FIG. 1, the container 52 and lid 54 can releasably mate at a connection rim 53 so as to maintain freshness and other product qualities of smokeless tobacco products 100 contained therein. Such qualities may relate to, without limitation, texture, flavor, color, aroma, mouth feel, taste, ease of use, and combinations thereof. In particular, the container 52 may have a generally cylindrical shape and include a base and a cylindrical side wall that at least partially defines the interior space 53. In some embodiments, the container is moisture-tight. Certain containers can be air-tight. The connection rim 53 formed on the container 52 provides a snap-fit engagement with the lid 54. It will be understood from the description herein that, in addition to the container 52, many other packaging options are available to hold one or more of the smokeless tobacco products 100.

In certain embodiments, each smokeless tobacco product 100 can be configured for oral use in a manner similar to that of an individual pouch containing tobacco therein. Briefly, in use, the system 50 can be configured so that an adult tobacco consumer can readily grasp at least one of the composite smokeless tobacco products 100 for placement in the adult tobacco consumer's mouth, thereby receiving a predetermined portion of smokeless tobacco with each smokeless tobacco products 100. In some embodiments, the predetermined portion of smokeless tobacco is generally consistent with each of the other smokeless tobacco products 100 stored in the container. For example, each composite smokeless tobacco product can provide between 0.25 and 4.0 grams of smokeless tobacco. Accordingly, the system 50 can permit an adult tobacco consumer to receive consistent portions of smokeless tobacco with each placement of the smokeless tobacco product 100 in his or her mouth. In certain embodiments, the adult tobacco consumer can experience the tactile and flavor benefits of having smokeless tobacco exposed yet contained within the adult tobacco consumer's mouth. The texture of a polymeric material exterior surface (e.g., an exterior surface including melt-blown polymeric fibers) may provide an adult tobacco consumer with a pleasing mouth feel. In some embodiments, the smokeless tobacco is a type of smokeless tobacco that is not suitable for industrial pouching machines, such as smokeless tobacco having an average aspect ratio of greater than 3 (e.g., long-cut smokeless tobacco). In some embodiments, an exterior surface includes a combination of polymeric fiber 110 and smokeless tobacco 105 that provides a unique tactile and flavor experience.

The container 52 and lid 54 can be separated from one another so that the adult tobacco consumer can have access to the one or more smokeless tobacco products 100 contained therein. Thereafter, the adult tobacco consumer can obtain a predetermined portion of smokeless tobacco 105 by readily grasping any one of the smokeless tobacco products 100 (e.g., without the need to estimate an amount of smokeless tobacco). The remaining portion of the smokeless tobacco products 100 can be enclosed in the container 52 when the lid 54 is reengaged with the container 52. During use, the polymeric material can keep the smokeless tobacco product cohesive and thus reduce the likelihood of substantial portions of smokeless tobacco breaking away and "floating" in the adult tobacco consumer's mouth. After the adult tobacco consumer has enjoyed the product 100, the adult tobacco consumer can remove the product 100 from his or her mouth and discard it. In some embodiments, the container 52 has an additional receptacle (e.g., a moisture permeable receptacle) for receiving used smokeless tobacco products.

Methods of Manufacture

One method of preparing the smokeless tobacco product includes directing polymeric strands having a diameter of less than 100 microns (or less than 50 microns, or less than 30 microns, or less that 10 microns, or less than 5 microns, or less than 1 microns, or less that 0.5 microns, or less than 0.1 microns, or less than 0.05 microns, or less than 0.01 microns) towards the smokeless tobacco such that the strands conform to the surface topography of the tobacco's fibrous structures. In some embodiments, the polymeric stands have a diameter of between 0.5 and 5 microns. In other embodiments, the polymeric strands can be delivered with smokeless tobacco and directed against a surface such that the polymeric strands conform to the smokeless tobacco's fibrous structures. The strands can contact the smokeless tobacco while at a temperature below the polymer's glass transition temperature, but the dimensions of the strands can be such that the fibrous polymer conforms with the surface topography of the tobacco's fibrous structure. The polymeric strands, once in place, can form the structural fibers discussed herein. In some embodiments, as discussed below, the strands are melt-blown against or with smokeless tobacco.

Another method of preparing the smokeless tobacco products includes bringing a polymeric material and smokeless tobacco into intimate contact while the polymeric material is at a temperature above its glass transition temperature to conform the polymeric material to a surface topography of the tobacco's fibrous structures. The polymeric material can be stabilized in contact with the smokeless tobacco by bringing the polymeric material below its glass transition temperature. The processes of bringing the smokeless tobacco and the polymeric material into contact and of conforming the polymeric material to the surface topography of the tobacco's fibrous structures can be performed step wise or simultaneously. In some embodiments, a polymeric material having a temperature above its glass transition temperature will be put into intimate contact with the smokeless tobacco such that the polymeric material conforms to the topography of the tobacco's fibrous structures upon contact. In other embodiments, a combination of polymeric material and smokeless tobacco can be heated while in contact to conform the polymeric material to the surface topography of the tobacco's fibrous structures.

These processes can be controlled such that the resulting composite tobacco product has a moisture-permeable porous surface and an overall oven volatiles content of between 4 and 61 weight percent. In some embodiments, the process is controlled to have an overall oven volatiles content of at least 30 weight percent.

Melt-Blowing Processes

One method to bring polymeric material and smokeless tobacco into intimate contact is by melt-blowing polymeric material against smokeless tobacco. In some embodiments, the melt-blown polymeric fibers are rapidly cooled to below their glass transition temperature prior to contacting the smokeless tobacco. The melt-blown polymeric fibers can have a diameter of less than 100 microns, less than 50 microns, less than 30 microns, less that 10 microns, less than 5 microns, less than 1 microns, less that 0.5 microns, less than 0.1 microns, less than 0.05 microns, or less than 0.01 microns. In some embodiments, the melt-blown polymeric fibers can have a diameter of between 0.5 and 5 microns. The flow of the melt-blown polymeric fibers (strands) and the dimensions of the polymeric fibers as they exit a melt blowing apparatus result in an intimate contact between the melt-blown fibers and the smokeless tobacco such that the melt-blown polymeric fibers conform to the surface topography of the tobacco's fibrous structures.

The melt-blown polymeric fibers, in other embodiments, retain sufficient latent heat from the melt-blowing process to remain above the polymer's glass transition temperature when placed in contact with the smokeless tobacco and thus to conform to the surface topography of the tobacco's fibrous structures. In still other embodiments, a composite of melt-blown polymeric fibers and smokeless tobacco can be subsequently heated to above the polymer's glass transition temperature to conform the melt-blown polymeric fibers to the surface topography of the tobacco's fibrous structures. In still other embodiments, melt-blowing processes, in addition to other processes, can be used to form a web of polymeric material that can be subsequently combined with smokeless tobacco and then heated to form the composite smokeless tobacco product.

Melt-blown polymeric fibers 110 can be produced using a melt-blowing device 120. Melt-blowing is an extrusion process where molten polymeric resins are extruded through an extrusion die and gas is introduced to draw the filaments to produce polymeric fibers. The gas can be heated air blown at high velocity through orifices that surround each spinerette. In other embodiments, layers of hot air are blown through slots between rows of spinerettes—the strands of polymeric material are attenuated by being trapped between two layers of air. Other methods of delivering the attenuating gas (e.g., heated air) are possible.

The polymeric fibers can be deposited onto a moving conveyor or carrier. FIGS. 2A-10 depict exemplary melt-blowing devices 120 and arrangements for combining melt-blown fibers 110 with a smokeless tobacco 105. Other melt-blowing devices are described in U.S. Pat. Nos. 4,380,570; 5,476,616; 5,645,790; and 6,013,223 and in U.S. Patent Applications US 2004/0209540; US 2005/0056956; US 2009/0256277; US 2009/0258099; and US 2009/0258562, which are hereby incorporated by reference.

Figure 2A:
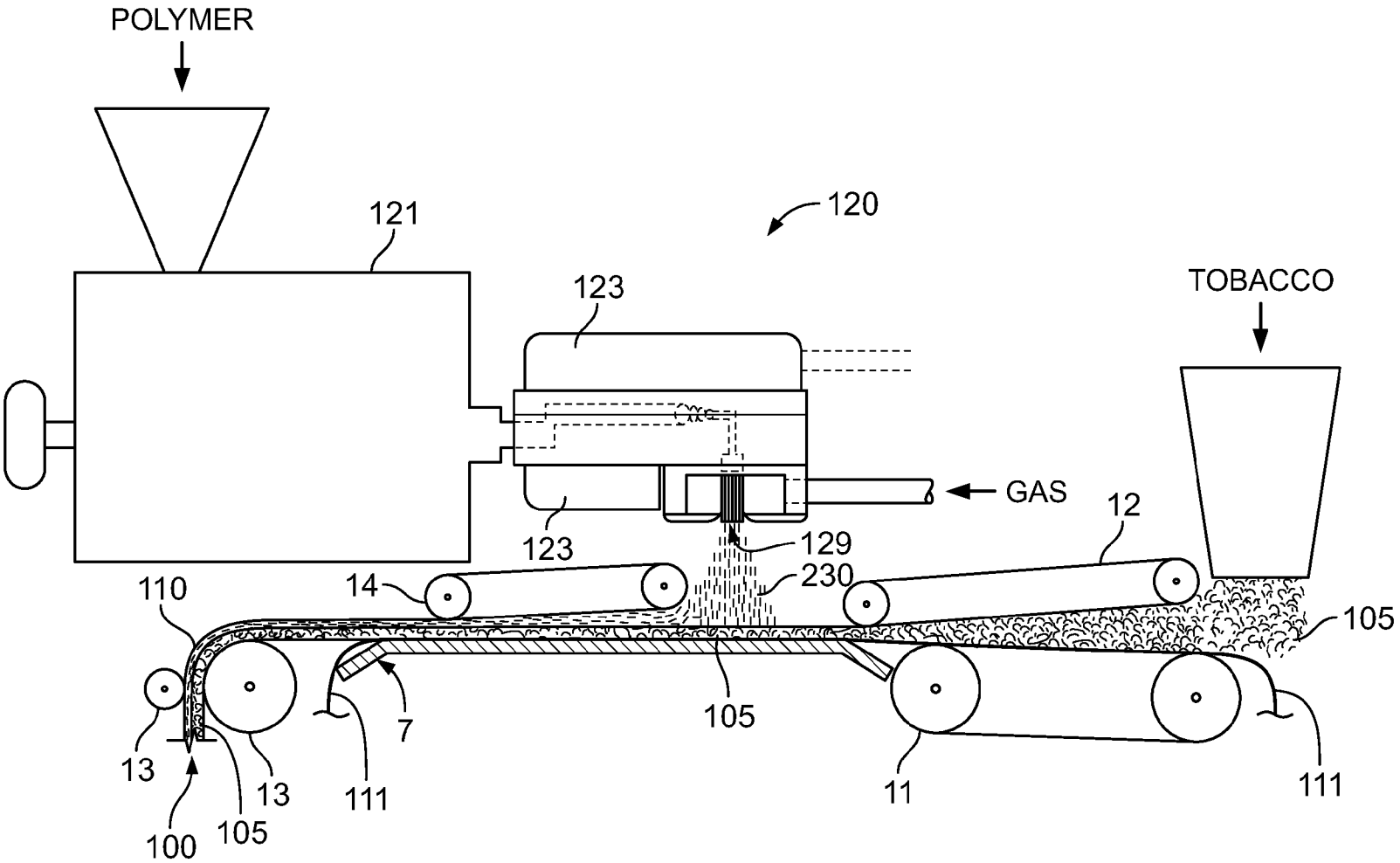
FIG. 2A is a schematic drawing of an exemplary method of making some embodiments of the smokeless tobacco products.
Figure 2B:
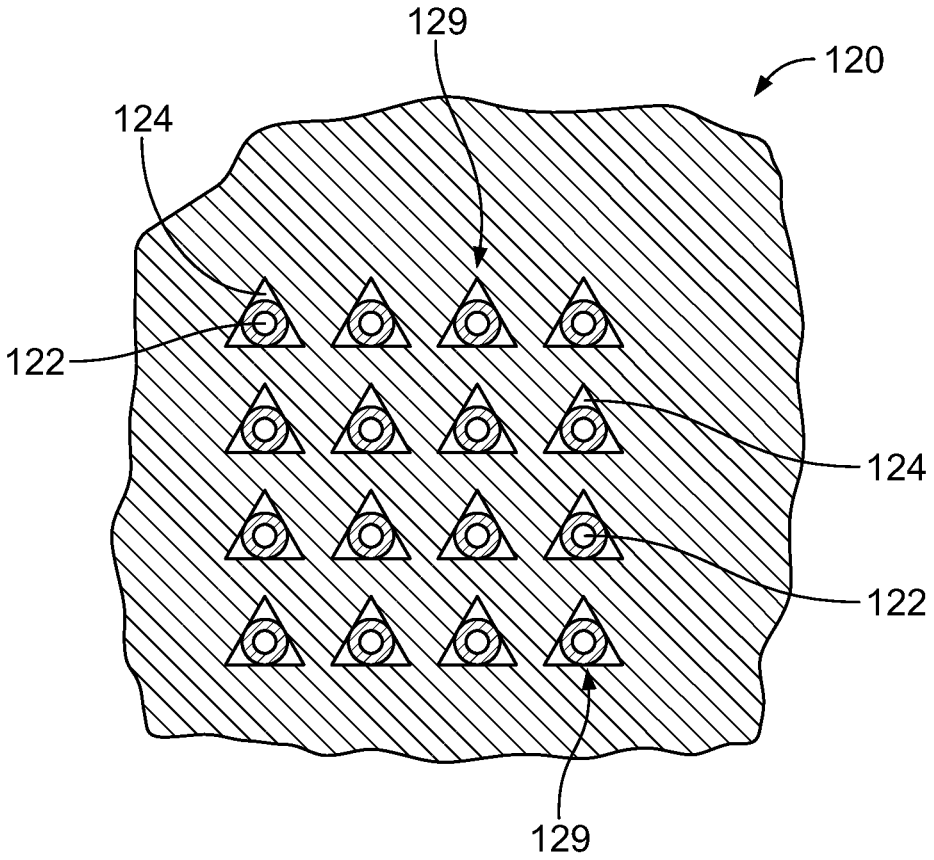
FIG. 2B depicts an exemplary arrangement of polymer orifices and air orifices for a melt-blowing apparatus.
Figure 3:
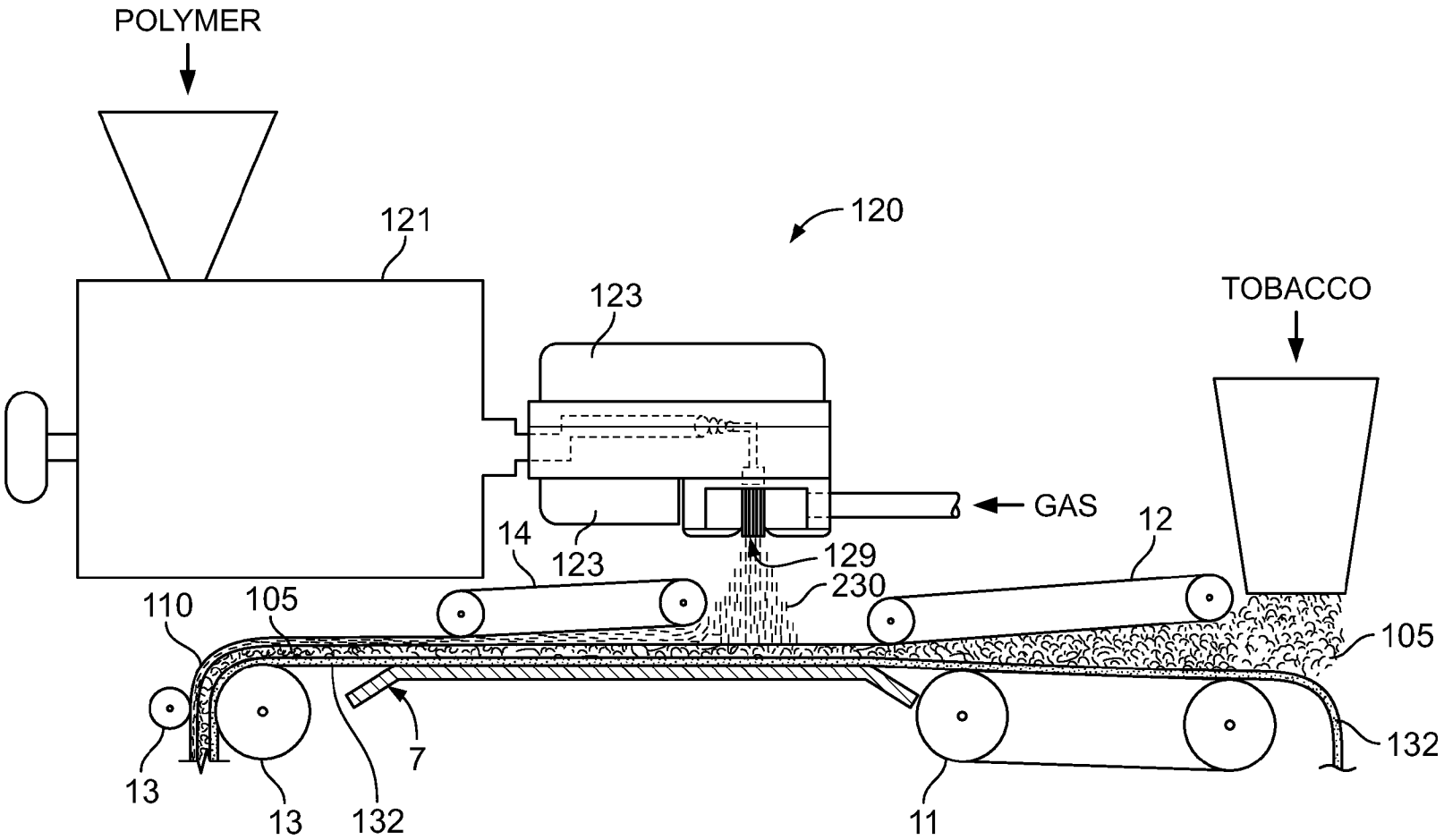
FIG. 3 is a schematic drawing of another exemplary method of making some embodiments of the smokeless tobacco products.

Referring now to FIGS. 2A, 2B and 3, a melt-blowing device 120 can include a polymer extruder 121 that pushes molten polymer at low melt viscosities through a plurality of polymer orifices 122. The melt-blowing device 120 includes one or more heating devices 123 that heat the polymer as it travels through the melt-blowing device 120 to ensure that the polymer remains above its melting point and at a desired melt-blowing temperature. As the molten polymer material exits the polymer orifice 122, the polymer material is accelerated to near sonic velocity by gas being blown in parallel flow through one or more air orifices 124. The air orifices 124 can be adjacent to the polymer orifices 122. As shown in FIG. 2B, the air orifices 124 may surround each polymer orifice 122. Each combination of a polymer orifice 122 with surrounding air orifices 124 is called a spinneret 129. For example, the melt-blowing device 120 can have between 10 and 500 spinnerets 129 per square inch. The polymer orifices 122 and the gas velocity through gas orifices 124 can be combined to form fibers of 100 microns or less. In some embodiments, the spinnerets each have a polymer orifice diameter of 30 microns or less. In some embodiments, the fibers have diameters of between 0.5 microns and 5 microns. The factors that affect fiber diameter include throughput, melt temperature, air temperature, air pressure, and distance from the drum. In some embodiments, the spinnerets 129 each have a polymer orifice diameter of less than 900 microns. In some embodiments, the spinnerets 129 each have a polymer orifice diameter of at least 75 microns. The average polymer orifice diameter can range from 75 microns to 900 microns. In particular embodiments, the average polymer orifice diameter can be between 150 microns and 400 microns. In certain embodiments, polymer orifice diameters of about 180 microns, about 230 microns, about 280 microns, or about 380 microns are used.

As shown in FIGS. 2A and 3, smokeless tobacco 105 may be deposited onto a carrier 111 or 132 and transported past the melt-blowing device 120 though a stream 230 of melt-blown polymer exiting an array of spinnerets 129 to deposit melt-blown polymeric fibers 110 onto the smokeless tobacco 105. In some embodiment, the melt-blown polymeric fibers 110 rapidly cools as it exits the spinnerets 129 and contacts the smokeless tobacco at a temperature below the polymer's glass transition temperature. The momentum and fiber dimensions, however, result in the melt-blown polymeric fibers conforming to the surface topography of the tobacco's fibrous structures. In other embodiments, the melt-blown polymeric strands can remain at a temperature above the polymer's glass transition temperature when the melt-blown polymeric fibers contact the smokeless tobacco so that the smokeless tobacco is secured by the melt-blown polymeric fibers, which at least in part conform to the surface topography of the tobacco's fibrous structures. The smokeless tobacco can become intermingled within or coated by a nonwoven network of the melt-blown polymeric fibers during the melt-blowing process. In particular embodiments, the smokeless tobacco 105 is compacted (e.g., subjected to a mechanical compacting process) prior to passing under spinnerets 129.

FIGS. 2A and 3 depict conveyors 12 that compact the deposited smokeless tobacco 105. The smokeless tobacco 105 can be pre-compressed to a desired thickness and density prior to melt-blowing the polymeric fiber 110. For example, the thickness of a compacted layer of smokeless tobacco prior to application of the melt-blown polymeric fiber can be between 1 mm and 5 mm, between 3 mm and 10 mm, between 0.5 cm and 2 cm, or between 1 cm and 3 cm. A polymeric fiber layer deposited over the compacted layer of smokeless tobacco can have a thickness of between 10 microns and 100 microns, of between 50 microns and 500 microns, of between 100 microns and 1000 microns, of between 0.5 mm and 5 mm, or of between 1 mm and 10 mm. For example, multiple layers of smokeless tobacco and multiple layers of melt-blown and/or spun bond structural fibers can be deposited in an alternating fashion. In some embodiments, the polymeric fiber layer can have a basis weight of 15 gsm or less, 12 gsm or less, 9 gsm or less, 6 gsm or less, or 3 gsm or less. In some embodiments, the polymeric fiber can have a basis weight of 1 gsm or more, 4 gsm or more, 7 gsm or more, 10 gsm or more, or 13 gsm or more. For example, the basis weight can be between 2 gsm and 10 gsm.

In other embodiments, not depicted, the smokeless tobacco 105 is deposited in a loose form and not compacted prior to depositing the melt-blown polymeric fibers 110. For example, the non-compacted smokeless tobacco can be long-cut smokeless tobacco. The melt-blowing arrangements can be as shown in FIGS. 2A and 3, but with conveyor 12 missing. A non-compacted layer of smokeless tobacco can have a thickness of between, for example, 0.1 inches and 3.0 inches. In some embodiments, multiple layers of non-compacted smokeless tobacco of between 0.1 and 1.0 inches thickness are successively deposited along with alternating layers of polymeric fiber, each layer of melt-blown polymeric fiber having a thickness of between 10 and 100 microns, of between 50 microns and 500 microns, of between 100 microns and 1000 microns, of between 0.5 mm and 5 mm, or of between 1 mm and 10 mm. In some embodiments, the layers of polymeric fiber alternate between melt-blown fibers and spun bond fibers. The resulting web can be cut width-wise, length-wise, and thickness-wise from a composite smokeless tobacco product 100 having the desired dimensions. For example, a composite smokeless tobacco product 100 having a dimensions of 1 inch×1 inch×0.1 inch may be made by (a) forming a 0.1 inch thick composite web of tobacco and polymeric material and cutting out a one inch square; or (b) by forming a 1 inch thick multilayered composite of tobacco and polymeric material and slicing off pieces every 0.1 inch.

In other embodiments, a non-compacted layer of smokeless tobacco having a thickness of between 0.25 and 3.0 inches can be coated with a melt-blown fiber layer having a thickness of between 10 and 100 microns and subsequently processed to more fully secure the smokeless tobacco to the melt-blown polymeric fibers. In some embodiments, a flow of melt-blown polymeric fibers is used to disrupt the smokeless tobacco and cause some of the smokeless tobacco to become intermingled within a nonwoven network of the melt-blown polymeric fibers. Air jets or blowers can also be used to disrupt the smokeless tobacco as it passes through the flow of melt-blown polymeric fibers leaving the melt-blowing apparatus 120.

In some circumstances, as shown in FIG. 2A, a carrier 111 may include a backing layer that does not contribute fibers to the final melt-blown smokeless tobacco product 100 and can be readily peeled away or removed after the melt-blowing process is completed. In some embodiments, the smokeless tobacco/melt-blown polymeric fiber composite is further processed to further secure the smokeless tobacco to the melt-blown polymeric fiber. For example, the smokeless tobacco/melt-blown polymeric fiber composite may be needled or heated. In other embodiments, the smokeless tobacco/melt-blown polymeric fiber composite may be folded and heat bonded with the smokeless tobacco layer forming the outer surfaces of the folded composite smokeless tobacco product.

In other embodiments, such as that shown in FIG. 3, smokeless tobacco 105 may be deposited onto a web 132 and the smokeless tobacco 105 may become secured between the web 132 and the melt-blown polymeric fibers 110. The web and the melt-blown polymeric fibers may be bonded using, for example, heat and pressure, ultrasonic bonding techniques, radio frequency bonding techniques, hydroentanglement, and/or needling techniques. The web 132 can be thin and/or porous. In some embodiments, web 132 is less than 30 microns thick. In some embodiments, web 132 can have a basis weight of less than 15 gsm. Web 132 may be formed in a separate melt-blowing process, a spun bond process, or formed using other processes. In some embodiments, the web 132 includes a polymeric material. Web 132, in other embodiments, can include a nonwoven natural fiber, such as cotton.

Multiple layers of smokeless tobacco 105 and melt-blown polymeric fiber 110 can be built up to a desired thickness. For example, the melt-blown smokeless tobacco products can have a thickness of between 0.1 and 1.0 inches. Accordingly, in some embodiments, multiple melt-blowing devices 120 and/or tobacco dispensers are alternated in series over a conveyor system to deposit alternating layers of melt-blown polymeric fibers and smokeless tobacco. By controlling the speed of the conveyor system and the rates of depositing melt-blown polymeric fiber and smokeless tobacco, the thickness of each layer can be controlled to have thicknesses in the ranges discussed above. In some embodiments, the thickness of each layer is sufficiently thin such that each melt-blown polymeric fiber layer mixes uniformly with the previously deposited layer of tobacco. The polymeric fibers of adjacent polymeric fiber layers can then be bonded to form a solid smokeless tobacco product 100 having a substantially uniform distribution of smokeless tobacco 105 within a nonwoven fabric. In other embodiments, the concentration of smokeless tobacco can vary between different layers of melt-blown polymer. For example, interior layers may have a lower concentration of smokeless tobacco. In certain embodiments, a layer or deposit of smokeless tobacco can be disrupted during or immediately prior to the melt-blowing process to distribute the smokeless tobacco throughout the melt-blown polymeric fibers. For example, air jets can be positioned underneath the carrier 11 or web 132 to project at least some of the smokeless tobacco into a "waterfall" 230 of the polymeric fiber leaving the spinnerets 129.

Figure 4A:
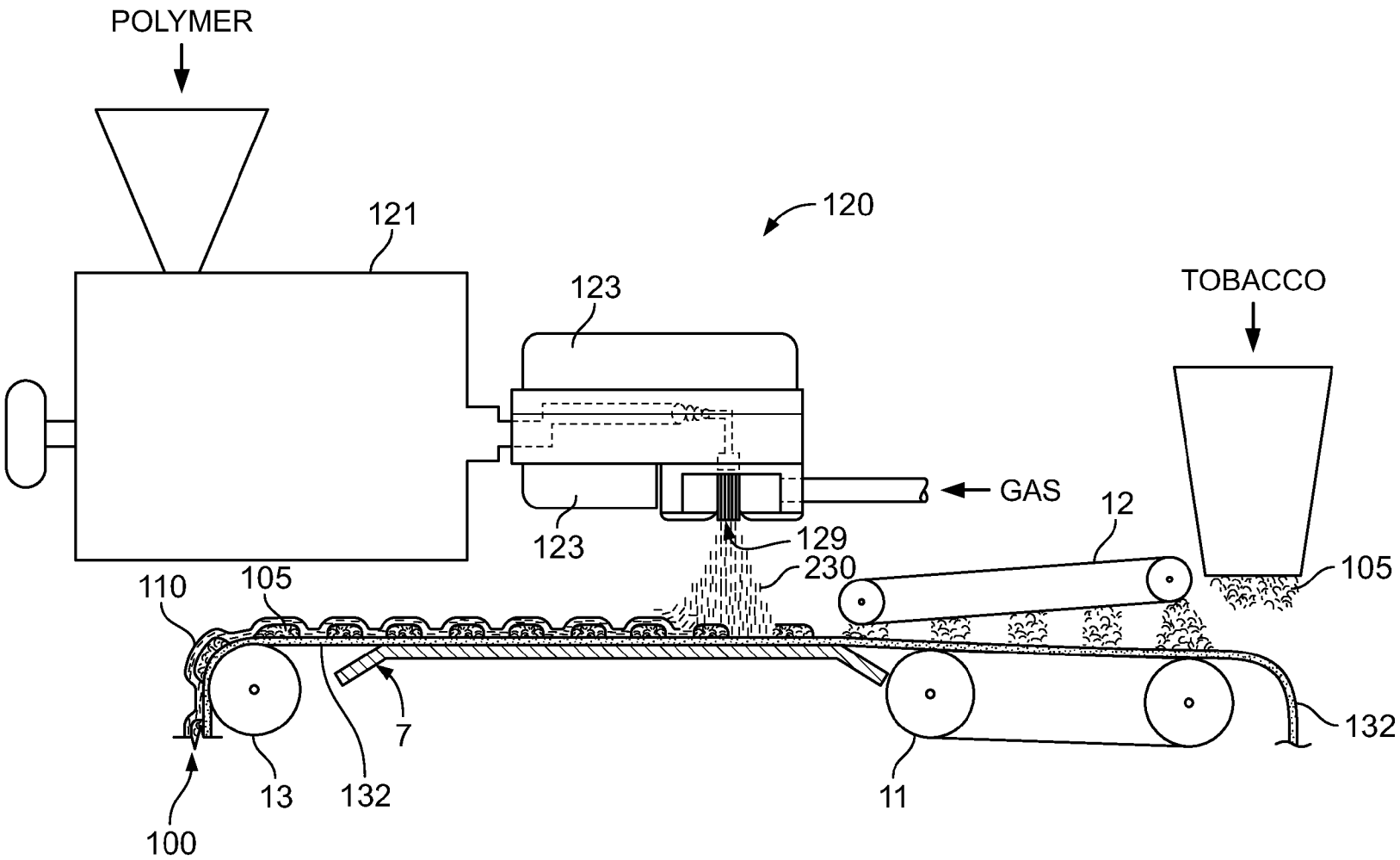
FIG. 4A is a schematic drawing of an exemplary method of making smokeless tobacco products.
Figure 4B:
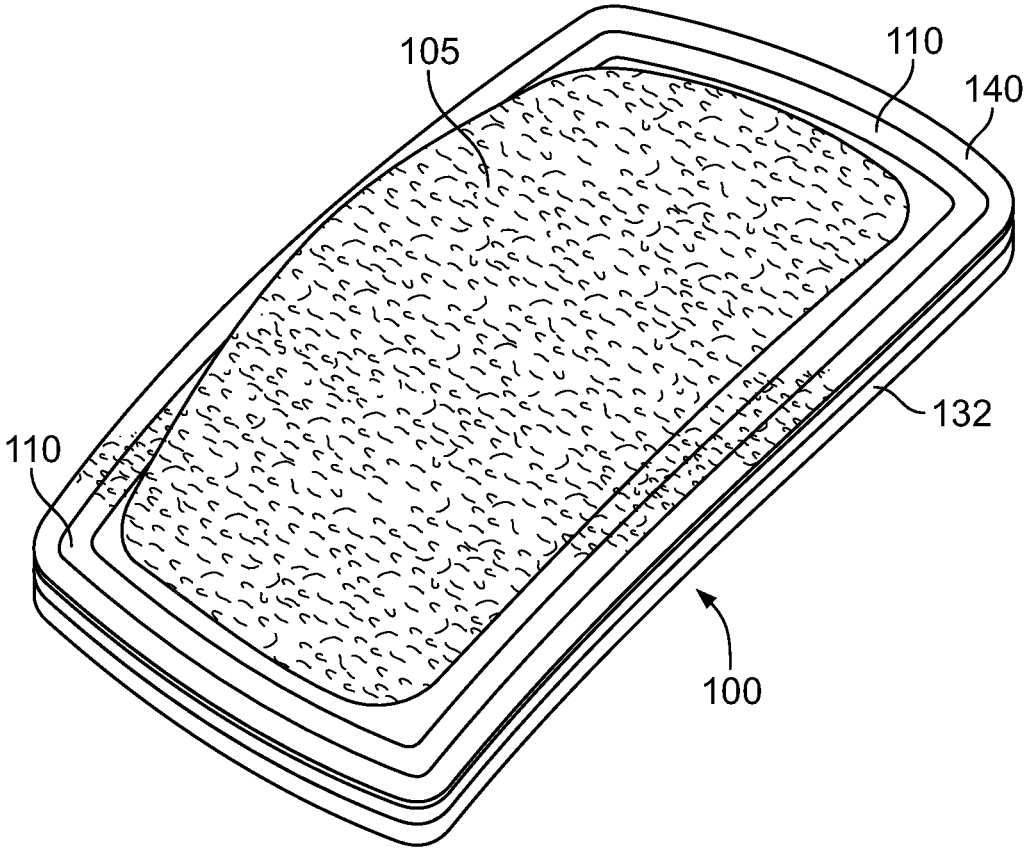
FIG. 4B depicts an exemplary embodiment of a smokeless tobacco product made using the apparatus of FIG. 4A.
Figure 4C:
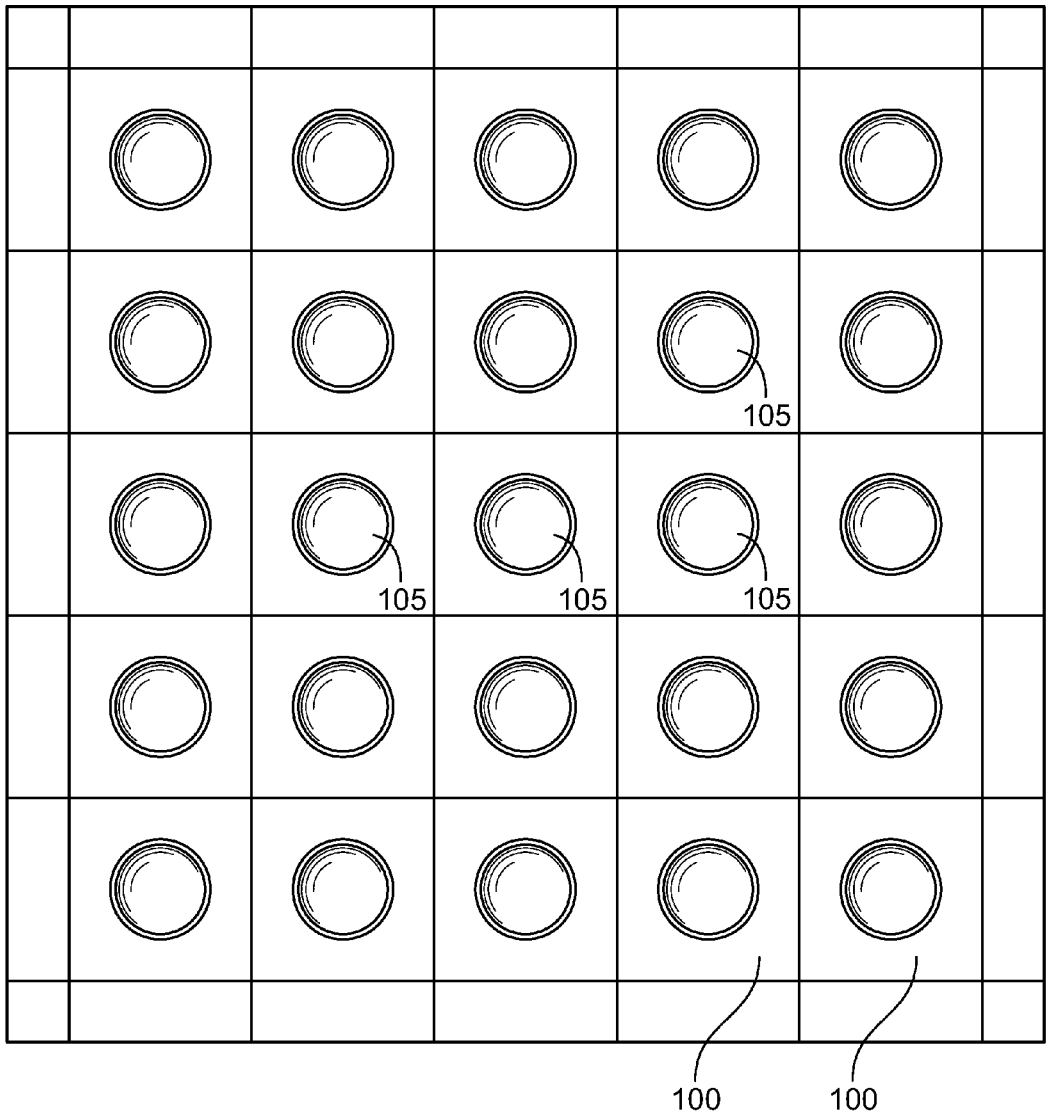
FIG. 4C depicts a plurality of smokeless tobacco products made using the apparatus of FIG. 4A.

In still other embodiments, as shown in FIGS. 4A-C, discrete deposits of smokeless tobacco 105 can be deposited and the layers of fibrous materials can be bonded around the periphery 140 of each discrete deposit of smokeless tobacco.

For example, discrete deposits of the smokeless tobacco 105 can be deposited onto a nonwoven fabric 132. In some embodiments, the discrete deposits includes a smokeless tobacco having an aspect ratio greater than 3 (e.g., long-cut smokeless tobacco). In some embodiments, one or more conveyor parts are shaped to size, compact, and/or position each discrete deposit. In other embodiments, the smokeless tobacco is deposited in a loose form. In some embodiments, loose deposits of smokeless tobacco can include a binder to help with the binding properties. For example, loose smokeless tobacco deposits can include less than 0.5 weight percent of a binder (e.g., 0.1 weight percent of guar gum, xanthan gum, cellulose ether, or similar materials or a combination thereof). For example, in some embodiments, conveyor 12 may include bumps, cavities, and/or ridges that correspond to predetermined discrete deposit sizes and shapes. Each discrete deposit can correspond approximately to an amount of smokeless tobacco generally found in a pouched smokeless tobacco product (e.g., between about 0.25 to 4.0 grams). For example, the smokeless tobacco product can include about 2.5 grams of smokeless tobacco. Melt-blown polymeric fiber 110 can then be deposited over the nonwoven fabric 132 and the decrete deposits 105 as a continuous layer. The melt-blown polymeric fibers 110 can bond with web 132 and conform to the surface topography of some of the tobacco's fibrous structures. The composite can then be die cut to separate the enveloped discrete deposits of smokeless tobacco. For example, a sheet of discrete deposits of smokeless tobacco enveloped by fibrous materials can be die cut along the lines shown in FIG. 4C.

Figure 5:
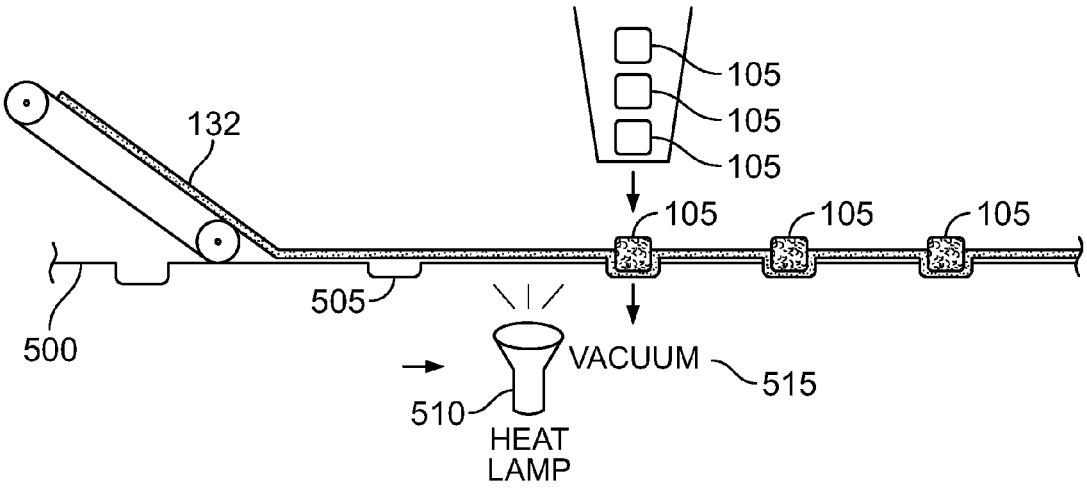
FIG. 5 is a schematic drawing of an exemplary method of shaping the bottom web of a smokeless tobacco product.

Web 132 can be preformed. Referring to FIG. 5, preformed web 132 can be deposited on a screen 500 having cavities 505 that correspond to discrete deposits of smokeless tobacco 105. In some embodiments, the screen 500 can move with the web 132 across a heating device 510 (e.g., a heat lamp). Discrete deposits of smokeless tobacco 105 (e.g., in the form of shaped bodies of smokeless tobacco) can be deposited onto the web in positions aligned with the cavities 505 such that the web 132 conforms to the cavities. In other embodiments, web 132 can be melt-blown onto screen 500 such that web 132 is formed with cavities formed in-situ. In still other embodiments, polymer can be melt blown on to a plurality of discrete deposits of smokeless tobacco within cavities, the resulting composite of polymeric fibers and smokeless tobacco deposits can then be flipped and the opposite side coated with melt-blown polymeric fibers.

Figure 6A:
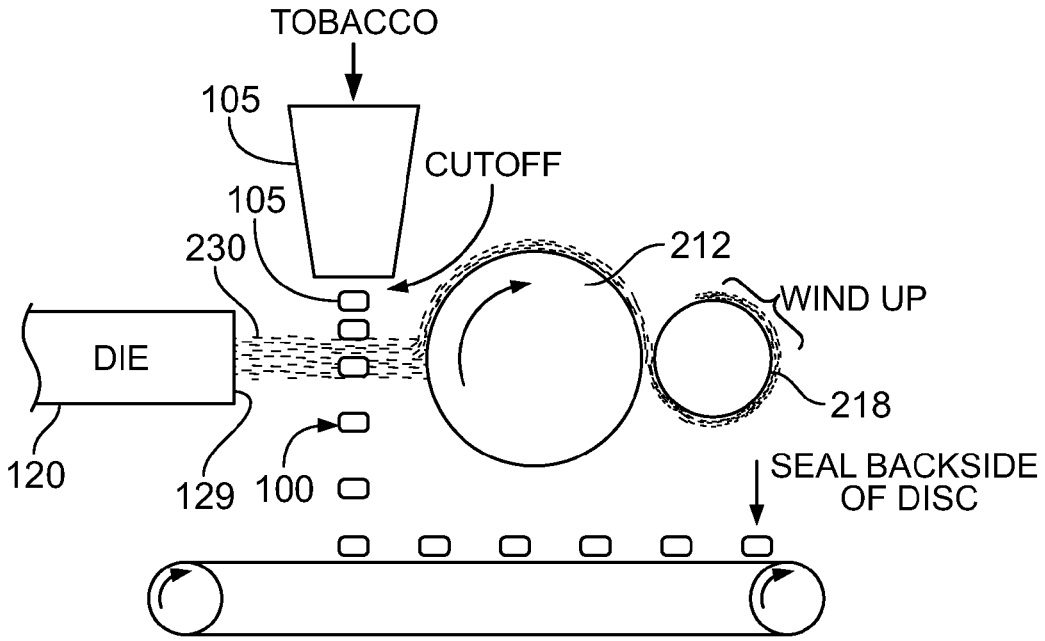
FIGS. 6A and 6B are schematic drawings of another exemplary method of making a smokeless tobacco product.
Figure 6B:
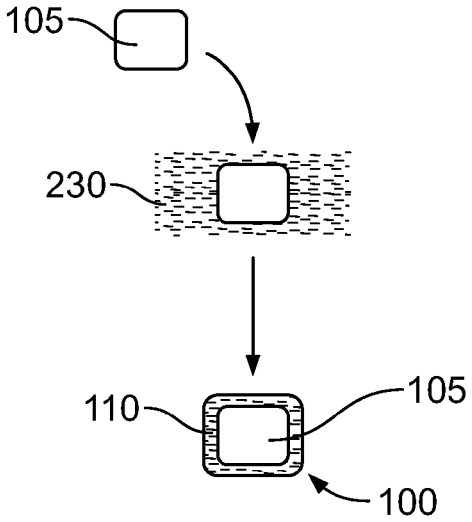

Smokeless tobacco can also be encapsulated in a layer of polymeric material by dropping bodies of smokeless tobacco 105 through a stream 230 of melt-blown polymeric fibers exiting an array of melt-blowing spinnerets. Referring to FIGS. 6A and 6B, smokeless tobacco bodies 105 can be formed such that they remain cohesive during a drop through a stream 230 of melt-blown fibers. The melt-blown fibers can be at a temperature above or below the polymer's glass transition temperature as the fibers impact the smokeless tobacco bodies 105. In some embodiments, air streams can be used to rotate the smokeless tobacco body 105 as it falls through the stream 610 to enhance to coverage of the body with polymeric fibers. If the process fails to fully encapsulate the smokeless tobacco bodies 105, the backside of the bodies can also be sealed in a downstream process. Excess melt-blown fibers can be rolled onto a vacuum roll 212 and then onto a wind up roll 218, and possibly used in other operations. In some embodiments, the smokeless tobacco body 105 includes one or more binders, such as a hydrocolloid, in an amount of between 0.5 weight percent and 5.0 weight percent. In certain embodiments, the smokeless tobacco products include between 0.5 and 1.5 weight percent binder. For example, the preformed smokeless tobacco products can include between 0.6 and 0.8 weight percent of a binder that includes guar gum, xanthan gum, cellulose ether, or similar materials or a combination thereof. In some embodiments, the smokeless tobacco body has a composition described in U.S. Provisional Application 61/421,931, which is hereby incorporated by reference, and thus can also have the properties described therein.

Referring back to FIGS. 2A, 3, and 4A, the melt-blown fibers 110, the smokeless tobacco 105, and the carrier 11 or web 132 are supported by a platform 7 during the melt-blowing process. In some embodiments, the platform is adapted to produce a vacuum in the area underneath the position of the spinnerets 129. The vacuum can pull the melt-blown polymeric fibers towards the platform 7 and may assist in fiber bonding. Porous layers (porous carrier(s) 11 or web 132, porous layers of smokeless tobacco 105, etc.) can permit the vacuum to pull the melt-blown polymeric fibers towards platform 7. In certain embodiments, an air stream for disrupting smokeless tobacco can be positioned immediately prior to the vacuum section of platform 7. In some embodiments, platform 7 is replaced with a rotating vacuum drum 212 or a moving conveyor 214 passing over a vacuum chamber. In other embodiments, no vacuum is used during the melt-blowing process, which may result in a more random distribution of fibers and less fiber-to-fiber bonding during an initial melt-blowing process.

Figure 7A:
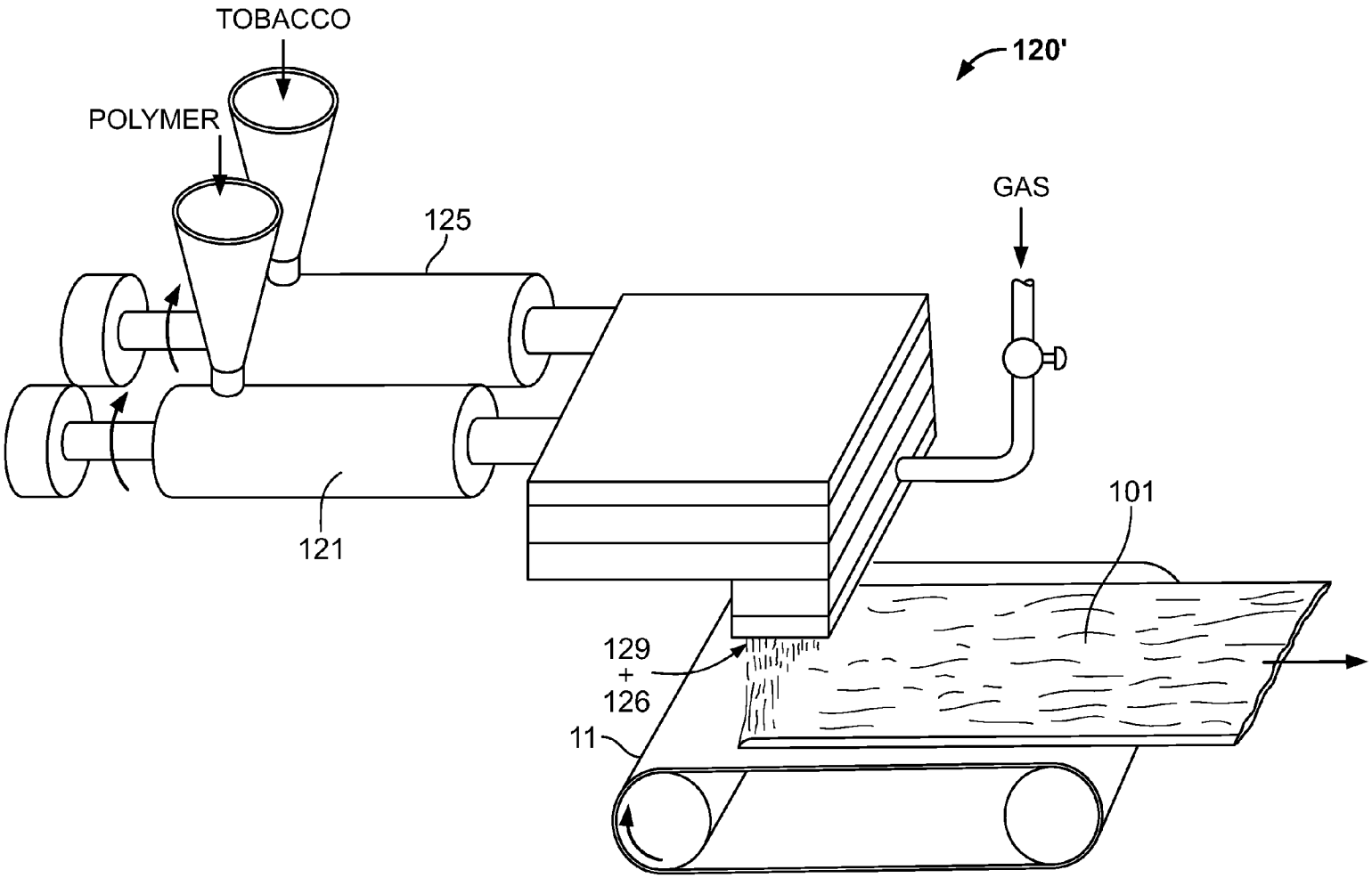
FIG. 7A is a schematic drawing of an exemplary method of making a smokeless tobacco product having a uniform distribution of smokeless tobacco within a nonwoven network of polymeric fibers.
Figure 7B:
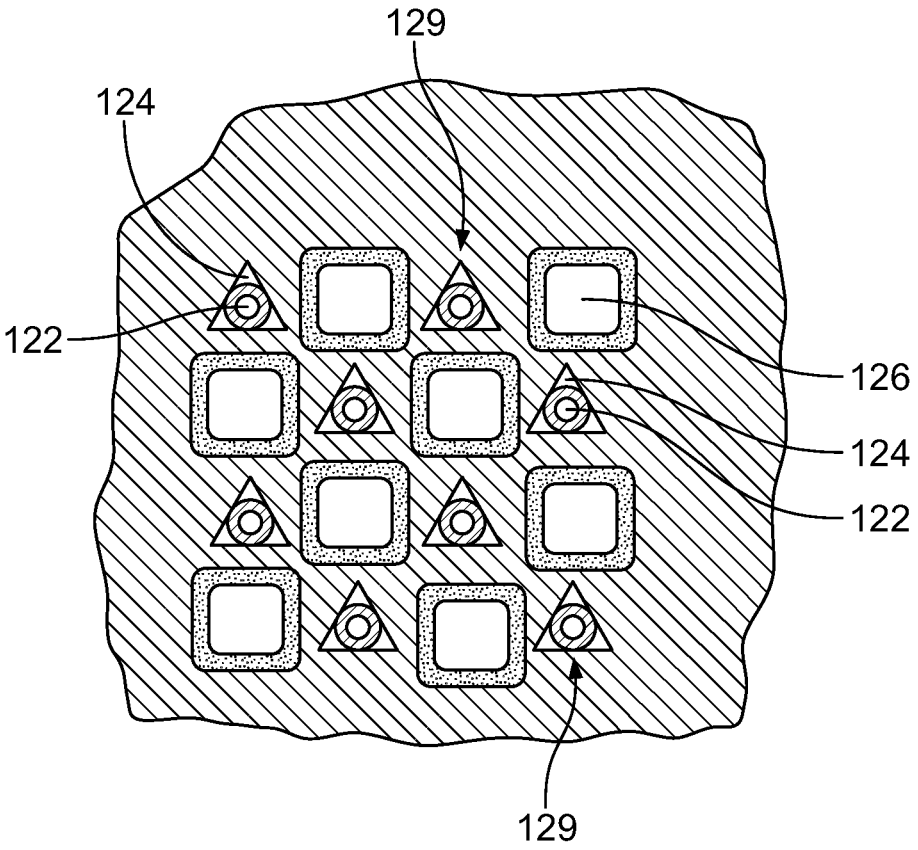
FIG. 7B depicts an exemplary arrangement of polymer orifices, air orifices, and smokeless tobacco dispensing orifices for a melt-blowing device that can dispense smokeless tobacco concurrently with melt-blowing a polymeric material.

Referring now to FIGS. 7A and 7B, a melt-blowing device 120' can also be configured to deliver smokeless tobacco 105 during the melt-blowing process. In addition to including a polymer extruder 121, a melt-blowing device 120' also includes a tobacco conveyor 125 that delivers smokeless tobacco 105 to be mixed with the melt-blown polymeric fibers 110 as the polymer material exits the polymer orifices 122. As shown in FIG. 7B, tobacco delivering orifices 126 may be placed adjacent polymer orifices 122 and air orifices 124. FIG. 7B, like the other figures, is not to scale. In practice the tobacco delivering orifices 126 may be one to several orders of magnitude larger than the polymer orifices 122. In other embodiments, tobacco delivering orifices 126 may be in rows between one or more rows of spinnerets 129. The precise dimensions and arrangement of the tobacco delivering orifices 126 will depend on the properties of the particular smokeless tobacco and the selected method of delivery. In some embodiments, the smokeless tobacco 105 is conveyed through the melt-blowing device 120' pneumatically in order to prevent clogging. In other embodiments, vibrating conveyors may be used. The combination of the smokeless tobacco 105 and the melt-blown polymeric fibers 110 can be deposited onto a conveyor belt 11 to form a homogeneous mass 101. As the smokeless tobacco intermingles with the melt-blown polymeric fibers, the polymeric fibers can at least partially conforms to the surface topography of some of the tobacco's fibrous structures. The speed of the conveyor belt 11 can be controlled to build a desired thickness (for example of between 0.1 and 1.0 inches). The homogeneous mass 101 may then be die cut into a desired shape to form the melt-blown smokeless tobacco products 100. In some embodiments, smokeless tobacco 105 is co-deposited with the melt-blown polymeric fibers 110 over a layer of smokeless tobacco 105. For example, the melt-blowing apparatus 120 of FIGS. 2 and 3 may be replaced with the melt-blowing apparatus 120' of FIGS. 7A and 7B. In some embodiments, conveyor belt 11 passes over a vacuum chamber or the conveyor belt could be replaced with a rotating vacuum drum. In other embodiments, no vacuum is used during the melt-blowing process.

Figure 8:
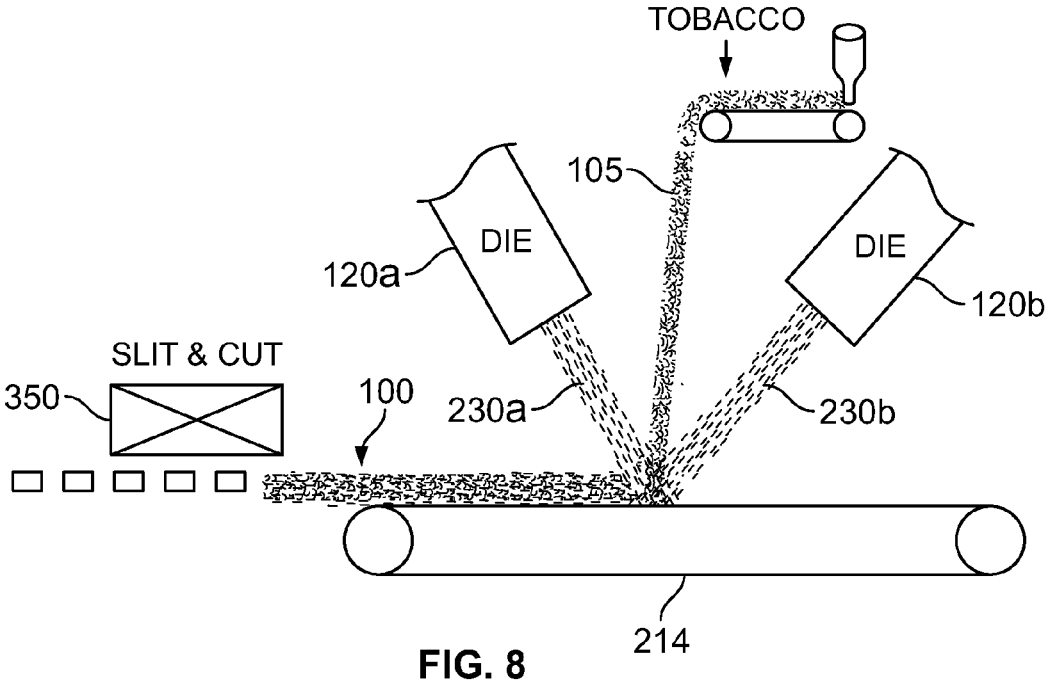
FIG. 8 is a schematic drawing of another exemplary method of making a smokeless tobacco product having a uniform distribution of smokeless tobacco within a nonwoven network of polymeric fibers.

Referring now to FIG. 8, loose smokeless tobacco 105 can be directed to fall into the high velocity fiber streams 230*a* and 230*b*. As the tobacco falls into the streams 230*a* and 230*b*, the tobacco's fibrous structures become intermingled with the polymeric fibers. In some embodiments, the fibers are melt-blown such that the fibers contact the loose smokeless tobacco at a temperature above or below its glass transition temperature, such that the polymeric fibers at least partially conform to a surface topography of the tobacco's fibrous structures. A cutting apparatus 850 can be used to cut the smokeless tobacco product 100 to desired dimensions. In some embodiments, the different melt blowing apparatuses 120*a* and 120*b* can deliver different structural fibers 110, both in terms of materials, dimensions, or even processes. For example, in some embodiments, one extruder provides a melt-blown polymeric fiber while a second extruder provides a spun bond fiber. In some embodiments, a composite smokeless tobacco product includes a combination of mouth-stable structural fibers and mouth-dissolvable fibers.

Mouth-stable structural fibers can include the full array of extrudable polymers, such as polypropylene, polyethylene, PVC, viscose, polyester, and PLA. In some embodiments, the mouth-stable structural fibers have low extractables, have FDA food contact approval, and/or be manufactured by suppliers who are GMP approved. Highly desirable are materials that are easy to process and relatively easy to approve for oral use (e.g. quality, low extractables, has FDA food contact approval, suppliers are GMP approved). Mouth-stable structural fibers can also include natural fibers, such as cotton or viscose (solvent cast). In some embodiments, the mouth-stable structural fibers are elastomers. Elastomers can provide webs with improved elongation and toughness. Suitable elastomers include VISTAMAX (ExxonMobil) and MD-6717 (Kraton). In some embodiments, elastomers can be combined with polyolefins at ratios ranging from 1:9 to 9:1. For example, elastomers (such as VISTAMAX or MD-6717) can be combined with polypropylene.

Figure 9:
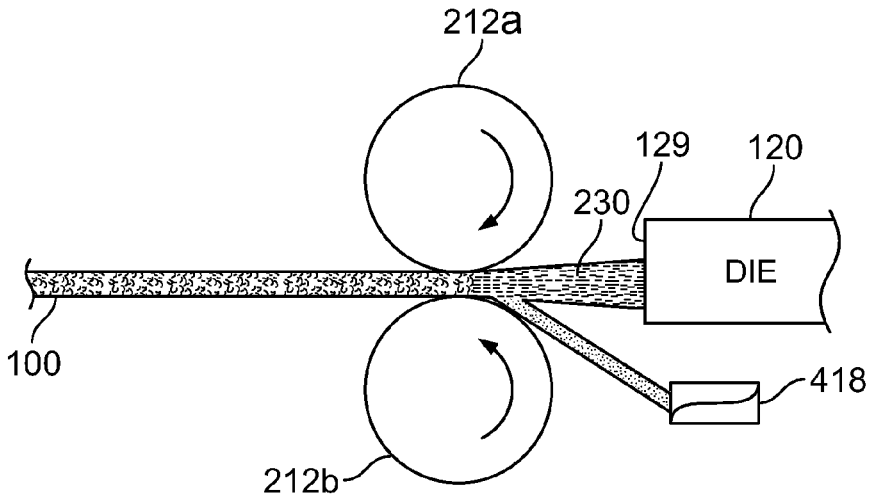
FIG. 9 is a schematic drawing of yet another exemplary method of making a smokeless tobacco product having a uniform distribution of smokeless tobacco within a nonwoven network of polymeric fibers.

Mouth-dissolvable fibers could be made from hydroxypropyl cellulose (HPC), methyl hydroxypropyl cellulose (HPMC), polyvinyl alcohol (PVOH), PVP, polyethylene oxide (PEO), starch and others. These fibers could contain flavors, sweeteners, milled tobacco and other functional ingredients. The fibers could be formed by extrusion or by solvent processes. Referring now to FIG. 9, smokeless tobacco material 105 can be blown by a blower 418 into a stream 230 of melt-blown polymeric fibers exiting a die in a horizontal melt-blowing process. The stream of smokeless tobacco 105 intermingled with the structural fiber 110 can be collected and calendared between a pair of vacuum drums 212*a* and 212*b*. Calendaring can be used in combination with optional heat (either added or latent) to bind the polymeric fibers together to provide additional cohesiveness.

Water vapor can be used to cool the polymeric material. For example, water vapor can be directed into the stream of molten strands of polymeric material to "quench" the polymeric strands and form the fibers. A fine mist of water vapor can quickly cool the strands below the polymer's glass transition temperature. In some embodiments, quenched melt-blown fibers can have improved softness and fiber/web tensile strength.

Other Processes for Forming Polymeric Materials

Spun Bond

Spun bond processes can also be used to provide the polymeric material for combining with the smokeless tobacco. In some embodiments, alternating layers of melt-blown polymeric fibers and spun bond polymeric fibers are combined with smokeless tobacco. The spun bond and melt-blown processes are somewhat similar from an equipment and operator's point of view and smokeless tobacco can be added to these processes in substantially similar manners. The two major differences between a typical melt-blown process and a typical spun bond process are: i) the temperature and volume of the air used to attenuate the filaments; and ii) the location where the filament draw or attenuation force is applied. A melt-blown process uses relatively large amounts of high-temperature air to attenuate the filaments. The air temperature can be equal to or slightly greater than the melt temperature of the polymer. In contrast, the spun bond process generally uses a smaller volume of air close to ambient temperature to first quench the fibers and then to attenuate the fibers. In the melt-blown process, the draw or attenuation force is applied at the die tip while the polymer is still in the molten state. Application of the force at this point can form microfibers but does not allow for polymer orientation. In the spun bond process, this force is applied at some distance from the die or spinneret, after the polymer has been cooled and solidified. Application of the force at this point provides the conditions necessary for polymer orientation, but is not conducive to forming microfibers. Accordingly, a spun bond process can be used to form a web and/or to combine the polymeric material with smokeless tobacco in substantially the same processes as discussed above. The spun bond polymeric fibers can, in some embodiments, be heated when in contact with or just prior to contact with smokeless tobacco so that the spun bond polymeric fibers at least partially conform to the surface topography of some of the tobacco's fibrous structures.

Electro Spinning

Electro spinning is a process that spins fibers of diameters ranging from 10 nm to several hundred nanometers; typically polymers are dissolved in water or organic solvents. The process makes use of electrostatic and mechanical force to spin fibers from the tip of a fine orifice or spinneret. The spinneret is maintained at positive or negative charge by a DC power supply. When the electrostatic repelling force overcomes the surface tension force of the polymer solution, the liquid spills out of the spinneret and forms an extremely fine continuous filament. These filaments are collected onto a rotating or stationary collector with an electrode beneath of the opposite charge to that of the spinneret where they accumulate and bond together to form nanofiber fabric. Electro spun nanofibers, in some embodiments, can be adapted to dissolve in the mouth. For example, fibers can be spun from water (or other solvent) solutions of soluble polymers such as HPC, HPMC, or PVOH; these fibers could contain flavors, sweeteners, milled tobacco or other functional ingredients. For example, the bulk of the composite smokeless tobacco product 100 can be made of one or multiple melt-blown layers designed from coarse to fine filaments and combined with electro spun nanofiber web. Melt-blown and/or spun bond layers can provide stability while an outer electro spun nanofiber layer can improve smoothness. In some embodiments, electro spun fibers are chopped and mixed with polymeric structural fibers (e.g., melt-blown or spun bond fibers) and thermally bonded within the network of structural fibers to provide a unique textural sensation. The thermal bonding process, in some embodiments, can result in polymeric electro spun fibers conforming to a surface topography of the tobacco's fibrous structures.

Force Spinning

Force spinning is a process that spins fibers of diameters ranging from 10 nm to 500 nm using a rotary drum and a nozzle, much like a cotton candy machine. The process makes use of a combination of hydrostatic and centrifugal pressure to spin fibers from the nozzle. For example, one type of force spinning is rotary jet spinning, where a polymeric material is retained inside a reservoir atop a controllable motor and extruded out of a rapidly rotating nozzle. Force spun nanofibers, in some embodiments, can be adapted to dissolve in the mouth. For example, fibers can be force spun from water (or other solvent) solutions of soluble polymers such as HPC, HPMC, or PVOH; these fibers could contain flavors, sweeteners, milled tobacco or other functional ingredients. The bulk of the composite smokeless tobacco product 100 can be made of one or multiple melt-blown layers designed from coarse to fine filaments and combined with force spun nanofiber web. Melt-blown and/or spun bond layers can provide stability while an outer force spun nanofiber layer can improve smoothness. In some embodiments, force spun fibers are chopped and mixed with polymeric structural fibers (e.g., melt-blown or spun bond fibers) and thermally bonded within the network of structural fibers to provide a unique textural sensation. The thermal bonding process can, in some embodiments, result in polymeric force spun fibers conforming to a surface topography of the tobacco's fibrous structures.

Polymer Web Forming Processes

Drylaying and Wetlaying processes can also be used to process polymeric fibers into a web. Drylaying processes, which are generally used on natural fibers, can use a series of pins to orient a mass of fibers. Wetlaying techniques, which are similar to paper making techniques, can also be used to arrange polymeric fibers. The polymeric structural fibers processed in drylaying and/or wetlaying processes can be combined with smokeless tobacco and heated to at least partially conform the polymeric structural fibers to the surface topography of some of the tobacco's fibrous structures. Smokeless tobacco can be combined with the polymeric fibers before, during, or after a drylaying or a wetlaying process. In some embodiments, these processes are used to make a web of polymeric fibers and the web are placed in contact with the smokeless tobacco, the combination of the web and the smokeless tobacco are heated to a temperature above or below the polymer's glass transition temperature to have the polymeric material conform to the tobacco's fibrous structures, and allowed to cool to stabilize the composite product. In some embodiments, the smokeless tobacco and the polymeric fibers are entangled (e.g., by needling as discussed below) prior to heating.

Other Polymeric Material Forms

Polymeric material can also be extruded and oriented into polymer sheets. In some embodiments, the polymeric material is a porous sheet of polymeric material. The porosity can be made by including a sacrificial material (e.g., a salt) that can be dissolved away after the extrusion process. Porous polymeric sheets can also be made using a variety of other techniques. The polymeric material can be placed against smokeless tobacco and heated to at least partially conform the plastic web to the surface topography of some of the tobacco's fibrous structures Additional Treatments In some circumstances, additional processes can be used can be used to further secure the smokeless tobacco to the polymeric material. These processes can occur before or after the polymeric material has been conformed to the tobacco's fibrous structures. In some embodiments, these processes include mechanical entanglement, such as needling, needle punching, needle felting, spun lacing, and hydroentanglement.

Figure 10:
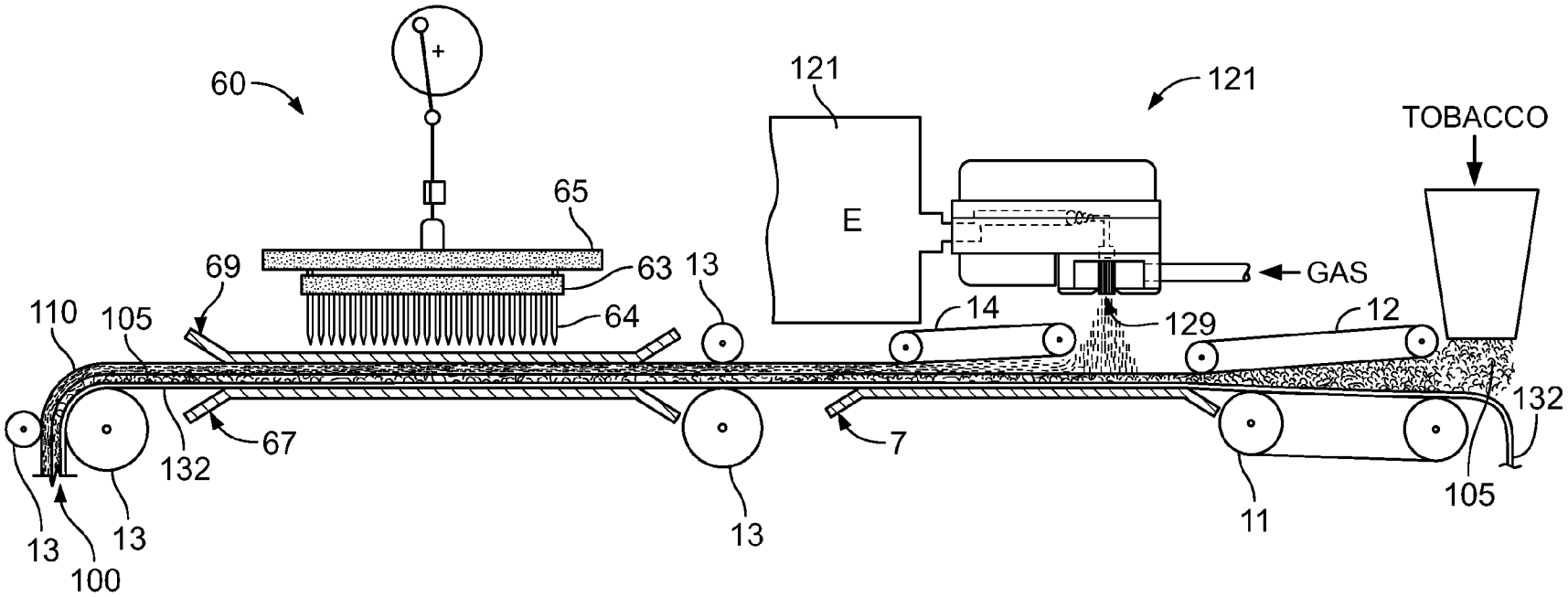
FIG. 10 is a schematic drawing of an exemplary method of further processing of a composite of the smokeless tobacco and the polymeric material.

Needling, also known as needle punching, is a process by which a fabric is mechanically formed by penetrating a web of fibers with an array of barbed needles that carry tufts of the fibers in a vertical direction. In some embodiments, polymeric fibers can be needled with smokeless tobacco to form a mixture of polymeric fibers and smokeless tobacco. Needling can be used after a polymeric fiber has been conformed to the surface topography of at least some of the tobacco's fibrous structures to further entangle the composite smokeless tobacco product 100. Referring now to FIG. 10, a smokeless tobacco/polymeric fiber composite can be additionally conveyed to a needle loom beam 65 after a stream 230 of polymeric fibers has been deposited onto the smokeless tobacco. The needle loom beam 65 is configured to reciprocate up and down so that the needles 64 penetrate in and out of corresponding holes in plates 67 and 69. In doing so, the needles penetrate the polymeric fibers 110, smokeless tobacco 105, and the fibers of web 132 while barbs on the blade of each needle 64 can pick up any of the fibers, including tobacco fibers, on the downward movement and carry these fibers the depth of the penetration. The reciprocation of the needles 64 occurs repeatedly while the rollers 11, 12, 13, and 14 forces the composite through the needle loom 60 as the needles reorient the fibers from a predominantly horizontal orientation to a generally vertical orientation.

Spun lace, also known as hydroentanglement, is a process that uses fluid forces to lock the fibers together. For example, fine water jets can be directed through a web of structural fibers, which is supported by a conveyor belt, to entangle the structural fibers together and/or with the tobacco's fibrous structures. Entanglement occurs when the water strikes the web and the fibers are deflected. The vigorous agitation within the web causes the fibers to become entangled. In some embodiments, a spun lacing process is used to entangle smokeless tobacco with a web of polymeric structural fibers prior to conforming the polymeric structural fibers to a surface topography of at least some of the tobacco's fibrous structures. In some embodiments, the smokeless tobacco is treated or encapsulated to retain soluble components during the spun lacing process. In some embodiments, soluble tobacco components are extracted from the smokeless tobacco prior to the spun lacing process and are added back to the finished, spun laced product after drying. In some embodiments, the spun-lacing liquid is a solution of flavorants or other additives.

Similar to spun lacing, the smokeless tobacco and polymeric fibers may also be air-jet entangled using high velocity streams of gas to entangle the fibers. In other embodiments, air jets can be used to intermingle smokeless tobacco with structural fibers prior to thermally bonding of the structural fibers to form a cohesive and/or dimensionally stable composite smokeless tobacco product 100.

Chemically bonding can also be used to further secure the smokeless tobacco product. For example, adhesive materials in the form of beads or small random shapes can be intermingled with the network of polymeric fibers and activated with heat and/or pressure to bond the network. In some embodiments, heat is used to both activate a chemical bonding agent and to bring the polymeric material above or below its glass transition temperature to conform the polymeric material to the tobacco's fibrous structures. In some embodiments, silicone or polyvinyl acetate is used as a chemical adhesive. In some embodiments, sodium alginate is added to the network and then a calcium salt added to make the alginate insoluble within the network and thus bond surrounding fibers. Chemical bonding can be used with any other technique described herein.

Conforming the Polymeric Material to the Tobacco's Fibrous Structures

The polymeric fibers can conform to the surface topography of the tobacco's fibrous structures due to the dimensions and momentum of polymeric strands (which become the polymeric fibers) being directed toward the smokeless tobacco. In other embodiments, the polymeric strands can be delivered with smokeless tobacco and can conform to the smokeless tobacco's fibrous structures due to impact against a surface. The polymeric fibers can have a diameter of less than 100 microns, less than 50 microns, less than 30 microns, less than 10 microns, less than 5 microns, less than 1 micron, less than 0.5 microns, less than 0.1 microns, less than 0.05 microns, or less than 0.01 microns. In some embodiments, the polymeric fibers have a diameter of between 0.5 and 5.0 microns. As discussed above, the latent heat of the melt-blown process can also be used to help conform the polymeric material to the surface topography of the tobacco's fibrous structures. In other embodiments, heating can be used shortly before, during, or after combining the smokeless tobacco with the polymeric material to raise the polymeric material's temperature to above its glass transition temperature. This heating can also cause thermal bonding between the various polymeric materials (e.g., polymeric structural fibers) and thus stabilize the product. In some embodiments, polymeric structural fibers are thermally bonded to stabilize or further stabilize the composite smokeless tobacco product. For example, a polymeric fiber web can be passed between heated calendar rollers to bond one or more portions of the web. In some embodiments, embossed rolls are used to provide point bonding, which can add softness and flexibility to the composite smokeless tobacco product.

As used herein, "conforming" means that the polymeric material provides an interlocking corresponding shape for the tobacco's fibrous structures. Conforming does not require that the polymeric material is shaped to match every micro- or nano-structure of the surface topography of the tobacco's fibrous structures. Instead, conforming only requires that the polymeric material is deposited against the surface topography such that there is some adhesion between the polymeric material and the smokeless tobacco's fibrous structures.

The optional heating of the polymeric material to a temperature above its glass transition temperature can be accomplished by using electrically heated surfaces, ultrasonic bonding, infrared energy, radio frequency energy, and microwave energy. Stitch bonding, point bonding, and quilting are methods of applying patterns to nonwoven fabrics. These are forms of thermal bonding typically achieved with ultrasonic bonding processes although other energy sources and related equipment can be used to create particular patterns of bonding within the network of fibers. Stitch bonding, point bonding, and quilting can all be used to conform polymeric fibers to at least portions of a surface topography of at least some of the tobacco's fibrous structures.

Bonding between the structural fibers can also be accomplished by incorporating a low melting temperature polymer into the network of structural fibers. The low melting temperature polymer could be introduced into the network in the form of fibers, beads, or random shapes. The low melting temperature polymer fibers, beads, or random shapes can be dispersed within the network of structural fibers. In some embodiments, the low melting temperature polymer has a melting point of between about 60° C. and 150° C. For example, low molecular weight fibers of polyethylene and polypropylene can be used as the low melting temperature polymer. In other embodiments, the low melting temperature polymer is polyvinyl acetate. For example, the lower melting temperature polymers, fibers, beads or random shapes could have a melting point of about 60 C to 150 C. By heating the composite of the structural fibers, the smokeless tobacco, and the low melting temperature polymeric material to a temperature between the melting points of the two different materials (thus also above the glass transition temperature of the low melting temperature polymer), the low melting temperature polymeric material can be selectively melted and thus bond to surrounding fibers and also conform to at least portions of a surface topography of at least some of the tobacco's fibrous structures. In some embodiments, the structural polymeric fibers are bicomponent or multicomponent fibers made of different materials.

The structural fibers can also be formed from multicomponent fibers that are fibrillated to break the multicomponent fiber up into multiple fibers. The multi component fibers can become fibrillated by applying force to the fibers. For example, hydroentanglement can be used to fibrillate a multicomponent fiber. In other embodiments, a pounding and/or crushing force (e.g., a hammer or pressure roller) can be applied to the multicomponent fiber. In some embodiments, a needling process can fibrillate a multicomponent fiber. In other embodiments, multicomponent fibers can be needled without becoming fibrillated, but become fibrillated in subsequent processes and/or during use by an adult tobacco consumer. In some embodiments, one multicomponent fiber can be fibrillated into many (e.g., 10 or more) microfibers. Additionally, the composite smokeless tobacco product can be embossed or coated with decorative designs, such as those described below. In some embodiments, dissolvable tobacco films and/or flavor films are coated onto at least part of at least one surface of the composite smokeless tobacco product.

Product Components

The smokeless tobacco products 100 include smokeless tobacco 105 and polymeric material 110. The smokeless tobacco product 100 can optionally include one or more flavorants and other additives. In some embodiments, smokeless tobacco 105 includes smokeless tobacco (e.g., moist, cured, fermented smokeless tobacco). The particular composition may, in part, determine the flavor profile and mouth feel of the smokeless tobacco products 100.

Polymeric Materials

Suitable polymeric materials include one or more of the following polymer materials: acetals, acrylics such as polymethylmethacrylate and polyacrylonitrile, alkyds, polymer alloys, allyls such as diallyl phthalate and diallyl isophthalate, amines such as urea, formaldehyde, and melamine formaldehyde, epoxy, cellulosics such as cellulose acetate, cellulose triacetate, cellulose nitrate, ethyl cellulose, cellulose acetate, propionate, cellulose acetate butyrate, hydroxypropyl cellulose, methyl hydroxypropyl cellulose (CMC), cellophane and rayon, chlorinated polyether, coumarone-indene, epoxy, polybutenes, fluorocarbons such as PTFE, FEP, PFA, PCTFE, ECTFE, ETFE, PVDF, and PVF, furan, hydrocarbon resins, nitrile resins, polyaryl ether, polyaryl sulfone, phenol-aralkyl, phenolic, polyamide (nylon), poly (amide-imide), polyaryl ether, polycarbonate, polyesters such as aromatic polyesters, thermoplastic polyester, PBT, PTMT, (polyethylene terephthalate) PET and unsaturated polyesters such as SMC and BMC, thermoplastic polyimide, polymethyl pentene, polyolefins such as LDPE, LLDPE, HDPE, and UHMWPE, polypropylene, ionomers such as PD and poly allomers, polyphenylene oxide, polyphenylene sulfide, polyurethanes (such as DESMOPAN DP 9370A available from Bayer), poly p-xylylene, silicones such as silicone fluids and elastomers, rigid silicones, styrenes such as PS, ADS, SAN, styrene butadiene latricies, and styrene based polymers, suflones such as polysulfone, polyether sulfone and polyphenyl sulfones, polymeric elastomers, and vinyls such as PVC, polyvinyl acetate, polyvinylidene chloride, polyvinyl alcohol, polyvinyl butyrate, polyvinyl formal, propylene-vinyl chloride copolymer, ethylvinyl acetate, and polyvinyl carbazole, polyvinyl pyrrolidone, and polyethylene oxide, and ethylene vinyl alcohol)).

The polymeric material can include multiple materials. In some embodiments, structural fibers of a first polymeric material are interspersed or layered with structural fibers of a second polymeric material. For example, a lower melting polymer can function as a binder which may be a separate fiber interspersed with higher melting structural polymer fibers. In other embodiments, structural fibers can include multiple components made of different materials. For example, a lower melting sheath can surround a higher melting core, which can help with the conforming and/or bonding processes. The components of a multi-component fiber can also be extruded in a side-by-side configuration. For example, different polymeric materials can be co-extruded and drawn in a melt-blowing or spun bond process to form the multi-component structural fibers.

In some embodiments, the polymeric material includes one mouth-stable material and one mouth-dissolvable material such that the smokeless tobacco product will loosen but remain cohesive as the mouth-dissolvable material dissolves away. In some embodiments, a network of structural polymeric fibers includes mouth-dissolvable polymeric fibers and mouth-stable polymeric fibers. As used herein, "mouth-stable" means that the material remains cohesive when placed in an adult tobacco consumer's mouth for 1 hour. As used herein, "mouth-dissolvable" means that the material breaks down within 1 hour after being exposed to saliva and other mouth fluids when placed in an adult tobacco consumer's mouth. Mouth-dissolvable materials include hydroxypropyl cellulose (HPC), methyl hydroxypropyl cellulose (HPMC), polyvinyl alcohol (PVOH), PVP, polyethylene oxide (PEO), starch and others. Mouth-dissolvable materials could be combined with flavors, sweeteners, milled tobacco and other functional ingredients. In other embodiments, multi-component fibers include a mouth-stable material and a mouth-dissolvable material.

In some embodiments, the polymeric material includes reconstituted cellulosic fibers. Reconstituted cellulosic fibers can be created from various woods and annual plants by physically dissolving the wood or plant material in a suitable solvent, such as methylmorpholine oxide (MNNO) monohydrate. The concentration of cellulose in the solution can be between 6 weight and 15 weight percent. The solution can then be spun (e.g., melt-blown or spun bond) at a temperature of between 70° C. and 120° C. to create reconstituted cellulosic fibers. In some embodiments, the reconstituted cellulosic fibers are made using tobacco material (e.g., tobacco stems). Reconstituted tobacco cellulosic fibers can then be intermingled with smokeless tobacco having natural cellulosic fibers to create a composite smokeless tobacco product having tobacco-derived structural fibers. The reconstituting process changes the composition of the tobacco and removes soluble tobacco components.

The polymeric material can also be combined with milled tobacco prior to contacting the tobacco with the smokeless tobacco. For example, milled tobacco could be combined into a polymeric structural fiber such that the polymeric material at least partially encapsulates the milled tobacco. For example, milled tobacco could be added to a molten polymer (e.g., polypropylene) in amounts of up to about 80% and extruded in a melt-blowing or spun bond process. The milled tobacco can provide a unique texture while the polymeric material remains mouth-stable and cohesive.

The amount of polymeric material used in the smokeless tobacco product 100 depends on the desired flavor profile and desired mouth feel. In some embodiments, the smokeless tobacco product 100 includes least 0.5 weight percent polymeric material, which can increase the likelihood that the smokeless tobacco product 100 maintains its integrity during packaging and transport. In certain embodiments, the smokeless tobacco product 100 includes up to 20 weight percent polymeric material. In some embodiments, the smokeless tobacco product includes 0.5 to 10.0 weight percent polymeric material. In some embodiments the smokeless tobacco products 100 have between 1.0 and 7.0 weight percent polymeric material.

Tobacco

Smokeless tobacco is tobacco suitable for use in an orally used tobacco product. By "smokeless tobacco" it is meant a part, e.g., leaves, and stems, of a member of the genus *Nicotiana* that has been processed. Exemplary species of tobacco include *N. rustica, N. tabacum, N. tomentosiformis*, and *N. sylvestris*. Suitable tobaccos include fermented and unfermented tobaccos. In addition to fermentation, the tobacco can also be processed using other techniques. For example, tobacco can be processed by heat treatment (e.g., cooking, toasting), flavoring, enzyme treatment, expansion and/or curing. Both fermented and non-fermented tobaccos can be processed using these techniques. In other embodiments, the tobacco can be unprocessed tobacco. Specific examples of suitable processed tobaccos include, dark air-cured, dark fire cured, burley, flue cured, and cigar filler or wrapper, as well as the products from the whole leaf stemming operation. In some embodiments, smokeless tobacco includes up to 70% dark tobacco on a fresh weight basis. For example, tobacco can be conditioned by heating, sweating and/or pasteurizing steps as described in U.S. Publication Nos. 2004/0118422 or 2005/0178398. Fermenting typically is characterized by high initial moisture content, heat generation, and a 10 to 20% loss of dry weight. See, e.g., U.S. Pat. Nos. 4,528,993; 4,660,577; 4,848,373; and 5,372,149. In addition to modifying the aroma of the leaf, fermentation can change either or both the color and texture of a leaf. Also during the fermentation process, evolution gases can be produced, oxygen can be taken up, the pH can change, and the amount of water retained can change. See, for example, U.S. Publication No. 2005/0178398 and Tso (1999, Chapter 1 in Tobacco, Production, Chemistry and Technology, Davis & Nielsen, eds., Blackwell Publishing, Oxford). Cured, or cured and fermented tobacco can be further processed (e.g., cut, expanded, blended, milled or comminuted) prior to incorporation into the smokeless tobacco product. The tobacco, in some embodiments, is long cut fermented cured moist tobacco having an oven volatiles content of between 48 and 50 weight percent prior to mixing with the polymeric material and optionally flavorants and other additives.

The tobacco can, in some embodiments, be prepared from plants having less than 20 μg of DVT per $cm^2$ of green leaf tissue. For example, the tobacco particles can be selected from the tobaccos described in U.S. Patent Publication No. 2008/0209586, which is hereby incorporated by reference. Tobacco compositions containing tobacco from such low-DVT varieties exhibits improved flavor characteristics in sensory panel evaluations when compared to tobacco or tobacco compositions that do not have reduced levels of DVTs.

Green leaf tobacco can be cured using conventional means, e.g., flue-cured, barn-cured, fire-cured, air-cured or sun-cured. See, for example, Tso (1999, Chapter 1 in Tobacco, Production, Chemistry and Technology, Davis & Nielsen, eds., Blackwell Publishing, Oxford) for a description of different types of curing methods. Cured tobacco is usually aged in a wooden drum (i.e., a hogshead) or cardboard cartons in compressed conditions for several years (e.g., two to five years), at a moisture content ranging from 10% to about 25%. See, U.S. Pat. Nos. 4,516,590 and 5,372,149. Cured and aged tobacco then can be further processed. Further processing includes conditioning the tobacco under vacuum with or without the introduction of steam at various temperatures, pasteurization, and fermentation. Fermentation typically is characterized by high initial moisture content, heat generation, and a 10 to 20% loss of dry weight. See, e.g., U.S. Pat. Nos. 4,528,993, 4,660,577, 4,848,373, 5,372,149; U.S. Publication No. 2005/0178398; and Tso (1999, Chapter 1 in Tobacco, Production, Chemistry and Technology, Davis & Nielsen, eds., Blackwell Publishing, Oxford). Cure, aged, and fermented smokeless tobacco can be further processed (e.g., cut, shredded, expanded, or blended). See, for example, U.S. Pat. Nos. 4,528,993; 4,660,577; and 4,987,907.

The smokeless tobacco can be processed to a desired size. For example, long cut smokeless tobacco typically is cut or shredded into widths of about 10 cuts/inch up to about 110 cuts/inch and lengths of about 0.1 inches up to about 1 inch. Double cut smokeless tobacco can have a range of particle sizes such that about 70% of the double cut smokeless tobacco falls between the mesh sizes of −20 mesh and 80 mesh. Other lengths and size distributions are also contemplated.

The smokeless tobacco can have a total oven volatiles content of about 10% by weight or greater; about 20% by weight or greater; about 40% by weight or greater; about 15% by weight to about 25% by weight; about 20% by weight to about 30% by weight; about 30% by weight to about 50% by weight; about 45% by weight to about 65% by weight; or about 50% by weight to about 60% by weight. Those of skill in the art will appreciate that "moist" smokeless tobacco typically refers to tobacco that has an oven volatiles content of between about 40% by weight and about 60% by weight (e.g., about 45% by weight to about 55% by weight, or about 50% by weight). As used herein, "oven volatiles" are determined by calculating the percentage of weight loss for a sample after drying the sample in a pre-warmed forced draft oven at 110° C. for 3.25 hours. The composite smokeless tobacco product can have a different overall oven volatiles content than the oven volatiles content of the smokeless tobacco used to make the composite smokeless tobacco product. The processing steps described herein can reduce or increase the oven volatiles content. The overall oven volatiles content of the composite smokeless tobacco product is discussed below.

The composite smokeless tobacco product can include between 15 weight percent and 85 weight percent smokeless tobacco on a dry weight basis. The amount of smokeless tobacco in a composite smokeless tobacco product on a dry weight basis is calculated after drying the composite smokeless tobacco product in a pre-warmed forced draft oven at 110° C. for 3.25 hours. The remaining non-volatile material is then separated into tobacco material and polymeric material. The percent smokeless tobacco in the composite smokeless tobacco product is calculated as the weight smokeless tobacco divided by the total weight of the non-volatile materials. In some embodiments, the composite smokeless tobacco product includes between 20 and 60 weight percent tobacco on a dry weight basis. In some embodiments, the composite smokeless tobacco product includes at least 28 weight percent tobacco on a dry weight basis. For example, a composite smokeless tobacco product can include a total oven volatiles content of about 57 weight percent, about 3 weight percent polymeric material, and about 40 weight percent smokeless tobacco on a dry weight basis.

In some embodiments, a plant material other than tobacco is used as a tobacco substitute in the composite smokeless tobacco product. The tobacco substitute can be an herbal composition. Herbs and other edible plants can be categorized generally as culinary herbs (e.g., thyme, lavender, rosemary, coriander, dill, mint, peppermint) and medicinal herbs (e.g., Dahlias, Cinchona, Foxglove, Meadowsweet, Echinacea, Elderberry, Willow bark). In some embodiments, the tobacco is replaced with a mixture of non-tobacco plant material. Such non-tobacco compositions may have a number of different primary ingredients, including but not limited to, tea leaves, red clover, coconut flakes, mint leaves, ginseng, apple, corn silk, grape leaf, and basil leaf. The plant material typically has a total oven volatiles content of about 10% by weight or greater; e.g., about 20% by weight or greater; about 40% by weight or greater; about 15% by weight to about 25% by weight; about 20% by weight to about 30% by weight; about 30% by weight to about 50% by weight; about 45% by weight to about 65% by weight; or about 50% by weight to about 60% by weight.

Flavorants and Additives

Figure 12A:
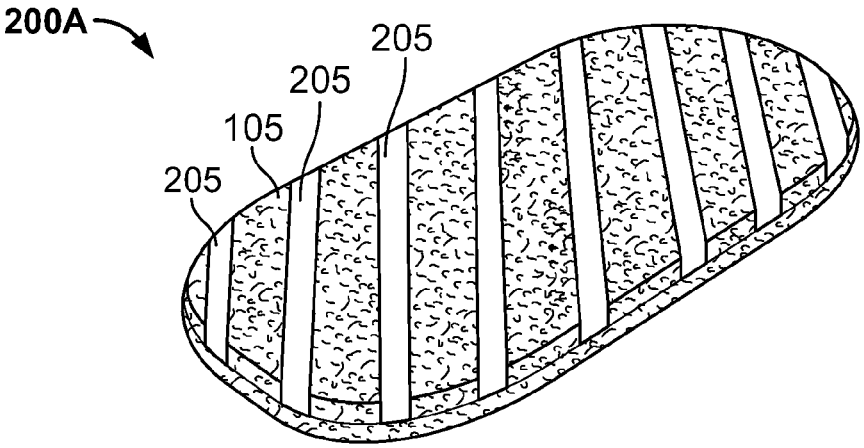
FIGS. 12A-C show exemplary smokeless tobacco products.

Flavors and other additives can be included in the compositions and arrangements described herein and can be added to the composite smokeless tobacco products at any point in the process of making the composite smokeless tobacco products. For example, any of the initial components, including the polymeric material, can be provided in a flavored form. In some embodiments, flavorants and/or other additives are included in the smokeless tobacco. In some embodiments, flavorants and/or other additives are absorbed into to the smokeless tobacco product 100 after the polymeric material and the tobacco's fibrous structures are combined. In some embodiments, flavorants and/or other additives are mixed with the polymeric material (e.g., with structural fibers) prior to mixing in the smokeless tobacco or heating the polymeric material to greater than its glass transition temperature. Alternatively or additionally, flavor can be applied prior to being further processed (e.g., cut or punched into shapes) or flavor can be applied prior to packaging. Referring to FIG. 12A, for example, some embodiments of a smokeless tobacco product 200A can be equipped with flavors, in the form of flavor strips 205.

Suitable flavorants include wintergreen, cherry and berry type flavorants, various liqueurs and liquors such as Drambui, bourbon, scotch, whiskey, spearmint, peppermint, lavender, cinnamon, cardamon, apium graveolents, clove, cascarilla, nutmeg, sandalwood, bergamot, geranium, honey essence, rose oil, vanilla, lemon oil, orange oil, Japanese mint, cassia, caraway, cognac, jasmin, chamomile, menthol, ilangilang, sage, fennel, piment, ginger, anise, coriander, coffee, liquorish, and mint oils from a species of the genus Mentha. Mint oils useful in particular embodiments of the composite smokeless tobacco products 100 include spearmint and peppermint.

Flavorants can also be included in the form of flavor beads, which can be dispersed within the composite smokeless tobacco product (e.g., in a nonwoven network of polymeric structural fibers). For example, the composite smokeless tobacco product could include the beads described in U.S. Patent Application Publication 2010/0170522, which is hereby incorporated by reference.

In some embodiments, the amount of flavorants in the composite smokeless tobacco product 100 is limited to less than 10 weight percent in sum. In some embodiments, the amount of flavorants in the composite smokeless tobacco product 100 is limited to be less than 5 weight percent in sum. For example, certain flavorants can be included in the composite smokeless tobacco product in amounts of about 3 weight percent.

Other optional additives include as fillers (e.g., starch, di-calcium phosphate, lactose, sorbitol, mannitol, and microcrystalline cellulose), soluble fiber (e.g., Fibersol from Matsushita), calcium carbonate, dicalcium phosphate, calcium sulfate, and clays), lubricants (e.g., lecithin, stearic acid, hydrogenated vegetable oil, mineral oil, polyethylene glycol 4000-6000 (PEG), sodium lauryl sulfate (SLS), glyceryl palmitostearate, sodium benzoate, sodium stearyl fumarate, talc, and stearates (e.g., Mg or K), and waxes (e.g., glycerol monostearate, propylene glycol monostearate, and acetylated monoglycerides)), plasticizers (e.g., glycerine, propylene glycol, polyethylene glycol, sorbitol, mannitol, triacetin, and 1,3 butane diol), stabilizers (e.g., ascorbic acid and monosterol citrate, BHT, or BHA), artificial sweeteners (e.g., sucralose, saccharin, and aspartame), disintegrating agents (e.g., starch, sodium starch glycolate, cross caramellose, cross linked PVP), pH stabilizers, or other compounds (e.g., vegetable oils, surfactants, and preservatives). Some compounds display functional attributes that fall into more than one of these categories. For example, propylene glycol can act as both a plasticizer and a lubricant and sorbitol can act as both a filler and a plasticizer.

Oven volatiles, such as water, may also be added to the composite smokeless tobacco product 100 to bring the oven volatiles content of the composite smokeless tobacco product into a desired range. In some embodiments, flavorants and other additives are included in a hydrating liquid.

Oven Volatiles

The smokeless tobacco product 100 can have a total oven volatiles content of between 10 and 61 weight percent. In some embodiments, the total oven volatiles content is at least 40 weight percent. The oven volatiles include water and other volatile compounds, which can be a part of the tobacco, the polymeric material, the flavorants, and/or other additives. As used herein, the "oven volatiles" are determined by calculating the percentage of weight loss for a sample after drying the sample in a pre-warmed forced draft oven at 110° C. for 3.25 hours. Some of the processes may reduce the oven volatiles content (e.g., heating the composite or contacting the smokeless tobacco with a heated polymeric material), but the processes can be controlled to have an overall oven volatiles content in a desired range. For example, water and/or other volatiles can be added back to the composite smokeless tobacco product to bring the oven volatiles content into a desired range. In some embodiments, the oven volatiles content of the composite smokeless tobacco product 100 is between 50 and 61 weight percent. For example, the oven volatiles content of smokeless tobacco 105 used in the various processed described herein can be about 57 weight percent. In other embodiments, the oven volatiles content can be between 10 and 30 weight percent.

Product Configurations

Figure 11A:
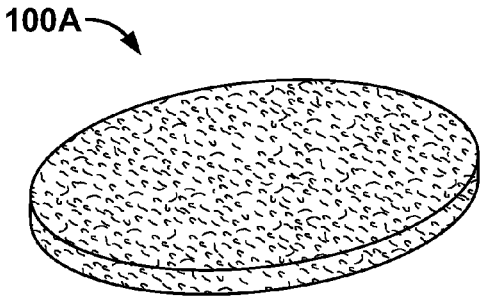
FIGS. 11A-L show exemplary various shapes into which a smokeless tobacco product can be cut or formed.
Figure 11B:
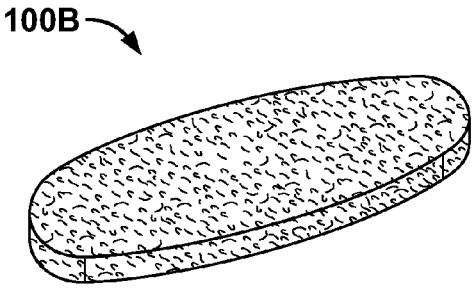
Figure 11C:
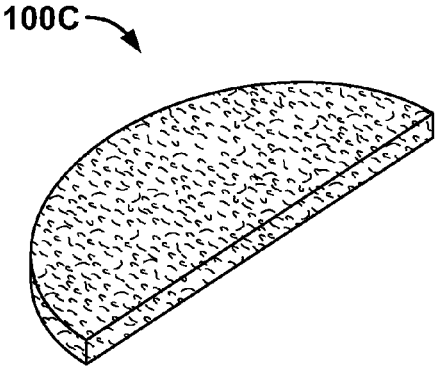
Figure 11D:
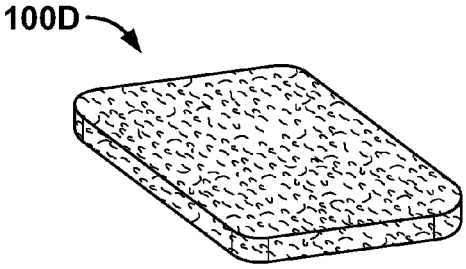
Figure 11E:
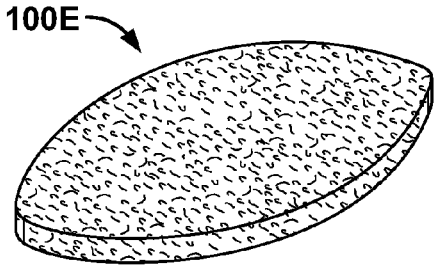
Figure 11F:
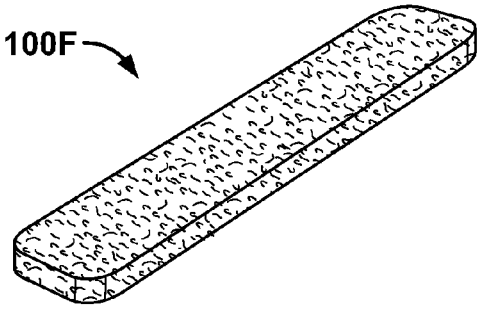
Figure 11G:
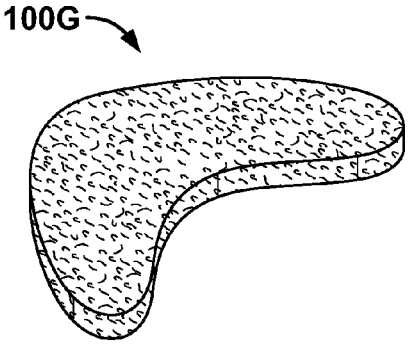
Figure 11H:
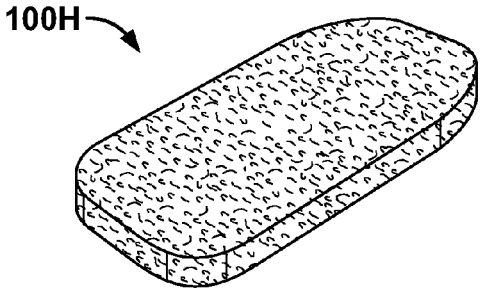
Figure 11I:
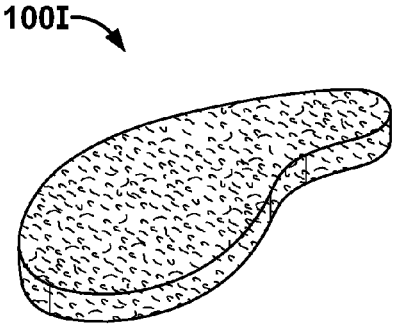
Figure 11J:
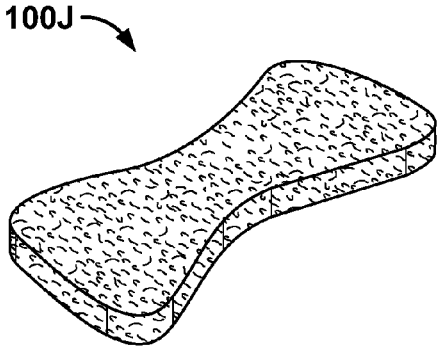
Figure 11K:
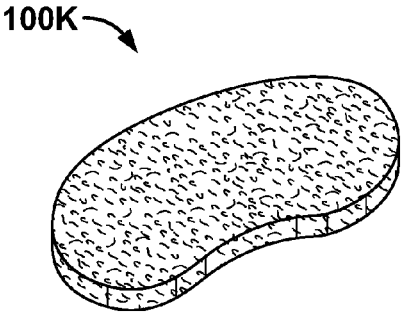
Figure 11L:
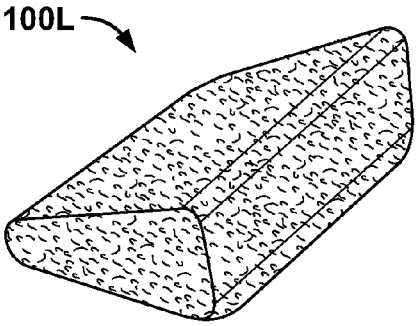

A smokeless tobacco product as described herein can have a number of different configurations, e.g., can have the configuration depicted in FIG. 1, or have a shape or a layered structure that is different from the particular embodiment of the composite smokeless tobacco product 100 depicted in FIG. 1. For example, referring to FIGS. 11A-K, the smokeless tobacco products 100A-K can be formed in a shape that promotes improved oral positioning for the adult tobacco consumer, improved packaging characteristics, or both. In some circumstances, the composite smokeless tobacco product can be configured to be: (A) an elliptical shaped composite smokeless tobacco product 100A; (B) an elongated elliptical shaped composite smokeless tobacco product 100B; (C) a semi-circular composite smokeless tobacco product 100C; (D) a square- or rectangular-shaped composite smokeless tobacco product 100D; (E) a football-shaped composite smokeless tobacco product 100E; (F) an elongated rectangular-shaped composite smokeless tobacco product 100F; (G) boomerang-shaped composite smokeless tobacco product 100G; (H) a rounded-edge rectangular-shaped composite smokeless tobacco product 100H; (I) teardrop- or comma-shaped composite smokeless tobacco product 100I; (J) bowtie-shaped composite smokeless tobacco product 100J; and (K) peanut-shaped composite smokeless tobacco product 100K. Alternatively, the smokeless tobacco product can have different thicknesses or dimensionality, such that a beveled composite smokeless tobacco product (e.g., a wedge) is produced (see, for example, the melt-blown smokeless tobacco product depicted in FIG. 11L) or a hemi-spherical shape is produced.

Smokeless tobacco products can be cut or sliced longitudinally or laterally to produce a variety of smokeless tobacco compositions having different tobacco/fiber profiles. For example, the texture (e.g., softness and comfort in the mouth), taste, level of oven volatiles (e.g., moisture), flavor release profile, and overall adult tobacco consumer satisfaction of a melt-blown smokeless tobacco product will be dependent upon the number of concentration and distribution of smokeless tobacco, and the number of layers, thicknesses, and dimensions and type(s) of melt-blown polymeric fibers, all of which effects the density and integrity of the final product. Similar to previously described embodiments, the smokeless tobacco products 100A-L depicted in FIGS. 11A-L can be configured to include a predetermined portion of smokeless tobacco 105, and the smokeless tobacco 105 can be exposed along a number of exterior surfaces of the composite smokeless tobacco products 100A-L. Further, the composite smokeless tobacco products 100A-L can be packaged in a container 52 with a lid 54 (FIG. 1) along with a plurality of similarly shaped smokeless tobacco products 100A-L so that an adult tobacco consumer can conveniently select any of the similarly shaped melt-blown smokeless tobacco products therein for oral use and receive a substantially identical portion of the smokeless tobacco 105.

In addition to including flavorants within the smokeless tobacco 105, flavorants can be included at many different places in the process. For example, the melt-blown polymeric fibers can include a flavorant added to the polymeric material prior to melt-blowing. Alternatively or additionally, flavor can be applied to the smokeless tobacco product prior to being further processed (e.g., cut or punched into shapes), or flavor can be applied to the smokeless tobacco products prior to packaging. Referring to FIG. 12A, for example, some embodiments of a smokeless tobacco product 200A can be equipped with flavorants, in the form of flavor strips 205. The flavor strips 205 can be applied to the smokeless tobacco 105 such that both the smokeless tobacco 105 and the flavor strip 205 are exposed along exterior surfaces of the composite smokeless tobacco product 200A. In some embodiments, the flavor strips 205 are applied to the smokeless tobacco product 200A after a melt-blowing process but before cutting or punching the composite smokeless tobacco product into the desired shape.

Figure 12B:
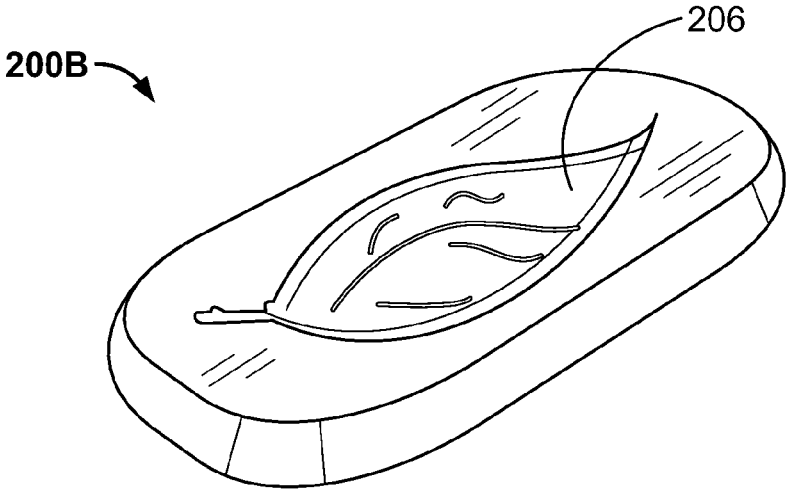
Figure 12C:
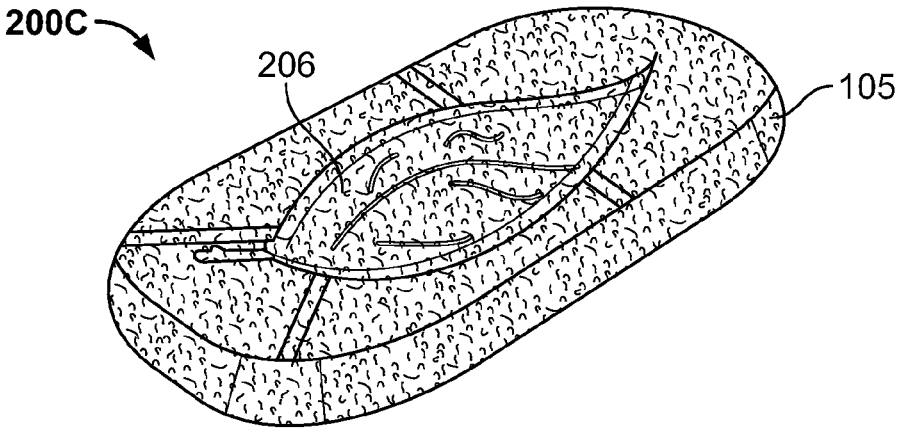

The smokeless tobacco product can be manipulated in a number of different ways. For example, as shown in FIG. 12B, particular embodiments of the smokeless tobacco product 200B can be wrapped or coated in an edible or dissolvable film. The dissolvable film can readily dissipate when the smokeless tobacco product 200B is placed in an adult tobacco consumer's mouth, thereby providing the adult tobacco consumer with the tactile feel of the smokeless tobacco 105 along the exterior of the composite smokeless tobacco product 200B once dissolved. In addition, or in the alternative, some embodiments of the smokeless tobacco products can be embossed or stamped with a design (e.g., a logo, an image, a trademark, a product name, or the like). For example, as shown in FIG. 12C, the melt-blown smokeless tobacco product 200C can be embossed or stamped with any type of design 206 including, but not limited to, an image. The design can be formed directly into or onto smokeless tobacco 105 arranged along the exterior of the smokeless tobacco product 200C. In other embodiments, a polymer fiber exterior can be embossed. The design 206 also can be embossed or stamped into those embodiments having a dissolvable film applied thereto, as illustrated in FIG. 12B.

In some embodiments, the composite smokeless tobacco product is used in combination with other tobacco and non-tobacco ingredients to form a variety of smokeless tobacco products. For example, the composite smokeless tobacco product can include flavor beads as discussed above.

Packaging

Figure 13A:
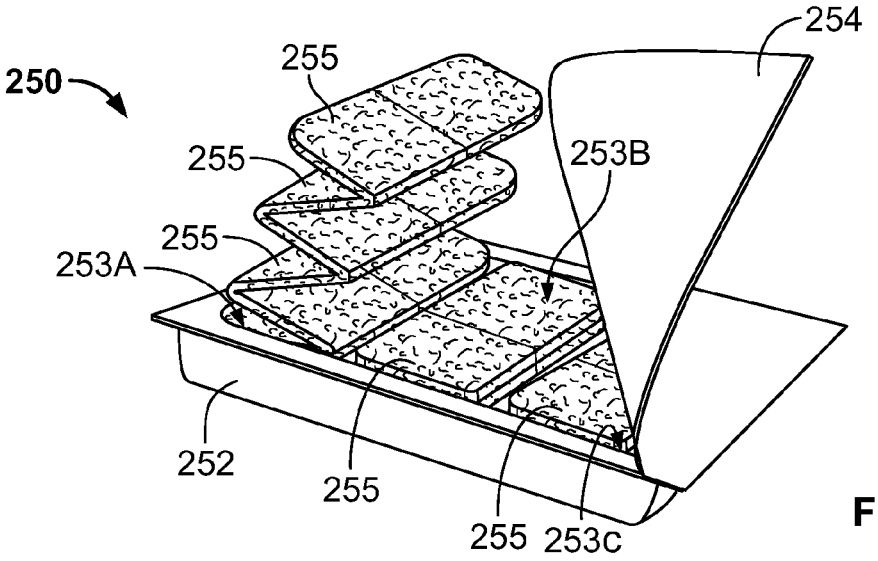
FIGS. 13A-C show representative packaging containers for smokeless tobacco products.

The smokeless tobacco products described herein can be packaged in any number of ways for convenient use. As previously described, the smokeless tobacco products can be packaged in individual pieces of any shape or size and contained, for example, in a generally cylindrical container 52 with a lid 54 (FIG. 1). Alternatively, as shown in FIG. 13A, the smokeless tobacco products can be packaged in a system including a tray container 252 with a peel-away lid 254. The tray container 252 can include a plurality of isolated interior spaces 253A-C so as to store separate stacks of the smokeless tobacco products 255. The smokeless tobacco product in the stacks can be folded upon itself. In some circumstances, the peel-away lid 254 can be resealable in that it can be repeatedly secured to the container 252.

Figure 13B:
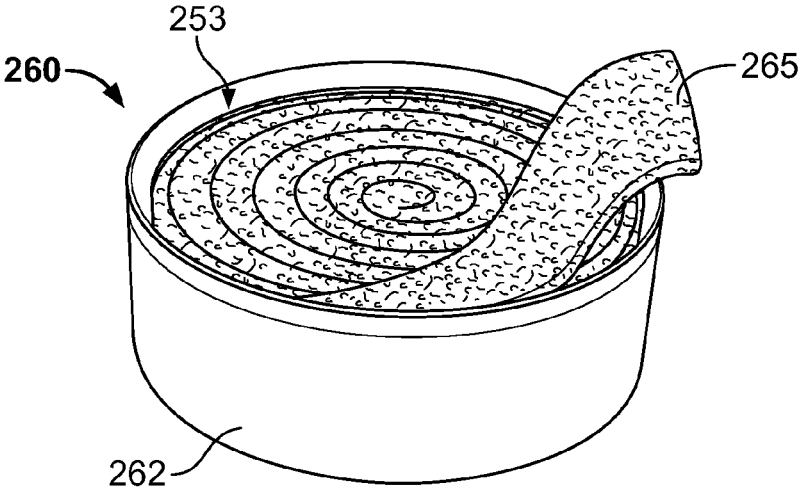
Figure 13C:
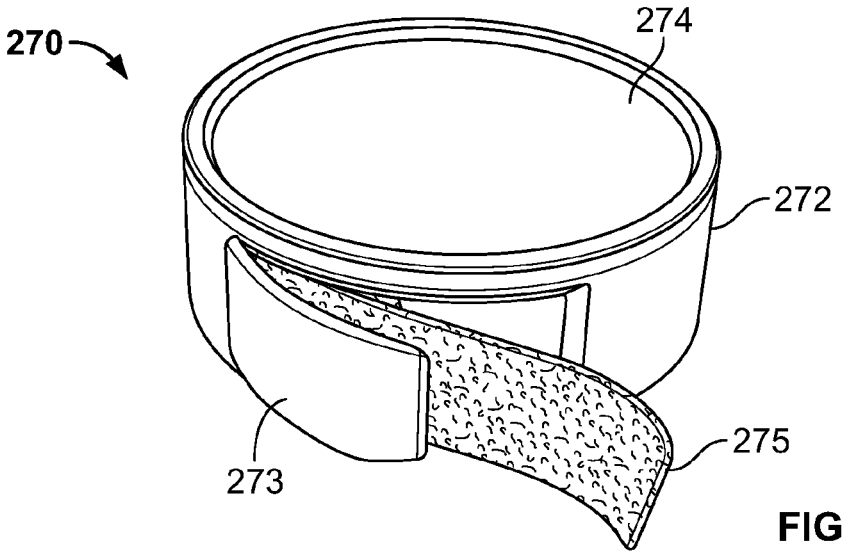

In another alternative system 260 depicted in FIG. 13B, melt-blown smokeless tobacco products can be cut into a strip of a particular width and packaged as a coil (e.g., rolled upon itself). As such, an adult tobacco consumer can readily tear or break away any length of the coil of smokeless tobacco product 265 for oral use. In some cases, the coil of smokeless tobacco products 265 can include perforations or scores that permit the adult tobacco consumer to more easily separate selected lengths of the coil 265. The coil of smokeless tobacco products can be contained in a container 262 having a cylindrical interior space 253 that is sized to receive the coil 265. In yet another alternative system 270 depicted in FIG. 13C, the coil of smokeless tobacco products 275 can be packaged in a container 272 that has a clipping device 273 on the side. The coil 275 can be stored in the container 272 having a lid thereon 274 (which may be removable), and the clipping device 273 can be hingedly connected to a sidewall of the container 272 so that a selected length of the coil 275 can be drawn out and readily clipped away. As such, the adult tobacco consumer can select the particular size of smokeless tobacco product to be inserted into the mouth.

In accordance with some embodiments described herein, there may be employed some conventional techniques within the skill of the art. Such techniques are explained fully in the literature. Some embodiments will be further described in the following examples, which do not limit the scope of the methods and compositions of matter described in the claims.

Prophetic Example

A composite smokeless tobacco product could be made by coating and/or encapsulating pieces of SKOAL Long Cut smokeless tobacco (Wintergreen flavored) having a moisture (i.e. oven volatiles) content of 57% with polypropylene fibers formed with a melt-blowing apparatus. Multiple stages of an extruder providing the polypropylene to the melt-blowing spinnerets can be operated at temperatures of between 280 F and 370 F. For example, the polypropylene can exit the spinnerets at a temperature of 355 F, at a pressure of between 50 and 400 psi (e.g., about 118 psi). The extrusion nozzle can be 0.011" or 0.023" and the throughput can be between 0.1 and 1.1 grams per hole per minute. Attenuating air can exit at a temperature of 350 F and a pressure of between 1 and 15 psi. The drum collector distance from the nozzle can be between 1 to 25 inches. The resulting melt-blown fibers can be controlled to have a basis weight of between 2 and 15 grams per square meter and a fiber diameter of between 0.5 and 5.0 microns.

Other Embodiments

It is to be understood that, while the invention has been described herein in conjunction with a number of different aspects, the foregoing description of the various aspects is intended to illustrate and not limit the scope of the invention, which is defined by the scope of the appended claims. Other aspects, advantages, and modifications are within the scope of the following claims.

Disclosed are methods and compositions that can be used for, can be used in conjunction with, can be used in preparation for, or are products of the disclosed methods and compositions. These and other materials are disclosed herein, and it is understood that combinations, subsets, interactions, groups, etc. of these methods and compositions are disclosed. That is, while specific reference to each various individual and collective combinations and permutations of these compositions and methods may not be explicitly disclosed, each is specifically contemplated and described herein. For example, if a particular composition of matter or a particular method is disclosed and discussed and a number of compositions or methods are discussed, each and every combination and permutation of the compositions and the methods are specifically contemplated unless specifically indicated to the contrary. Likewise, any subset or combination of these is also specifically contemplated and disclosed

What is claimed is:

1. A smokeless tobacco product comprising:

smokeless tobacco; and structural fibers comprising a polyurethane material and having a diameter of less than 100 microns, the structural fibers forming a moisture-permeable porous surface around the smokeless tobacco.

2. The smokeless tobacco product of claim 1, wherein the structural fibers are conformed with at least a portion of an outer surface of a body of the smokeless tobacco.

3. The smokeless tobacco product of claim 1, wherein the smokeless tobacco product has an overall oven volatiles content of about 40% by weight to about 60% by weight.

4. The smokeless tobacco product of claim 1, wherein the smokeless tobacco product has dimensional stability.

5. The smokeless tobacco product of claim 1, wherein the polyurethane material is in the form of structural fibers that are at least partially mouth-stable and the smokeless tobacco product is adapted to remain substantially cohesive when placed in an adult tobacco consumer's mouth and exposed to saliva.

6. The smokeless tobacco product of claim 1, wherein the structural fibers further comprise polypropylene fibers.

7. The smokeless tobacco product of claim 1, wherein the structural fibers further comprise reconstituted cellulosic fibers.

8. The smokeless tobacco product of claim 7, wherein the reconstituted cellulosic fibers are reconstituted by dissolving and spinning tobacco plant material.

9. The smokeless tobacco product of claim 1, wherein the structural fibers encapsulate a body of the smokeless tobacco.

10. The smokeless tobacco product of claim 1, wherein the polyurethane material is in the form of polyurethane fibers intermingled with cellulosic fibers.

11. The smokeless tobacco product of claim 1, wherein the smokeless tobacco product comprises multiple layers of structural fibers and multiple layers of smokeless tobacco.

12. The smokeless tobacco product of claim 1, wherein the smokeless tobacco product is folded or rolled upon itself.

13. The smokeless tobacco product of claim 1, further comprising a dissolvable film at least partially coating the smokeless tobacco product.

14. The smokeless tobacco product of claim 1, wherein the smokeless tobacco comprises cured tobacco.

15. The smokeless tobacco product of claim 14, wherein the smokeless tobacco comprises cured, aged, fermented tobacco.

16. The smokeless tobacco product of claim 14, wherein the smokeless tobacco comprises cured, aged, non-fermented tobacco.

17. A packaged smokeless tobacco product comprising:

a container that defines a moisture-tight interior space; and at least one smokeless tobacco product disposed in the moisture-tight interior space, the at least one smokeless tobacco product including smokeless tobacco and structural fibers comprising a polyurethane material and having a diameter of less than 100 microns, the structural fibers forming a moisture-permeable porous surface around the smokeless tobacco.

18. The packaged smokeless tobacco product of claim 17, wherein the at least one smokeless tobacco product comprises a plurality of similarly shaped smokeless tobacco products disposed in the interior space.

19. The packaged smokeless tobacco product of claim 17, wherein the container defines a second interior space for the disposal of used smokeless tobacco products.

20. The packaged smokeless tobacco product of claim 19, wherein the second interior space is moisture permeable.

* * * * *